United States Patent [19]

Lathom et al.

[11] Patent Number: 4,808,886

[45] Date of Patent: Feb. 28, 1989

[54] SWITCHED CAPACITIVE BALLASTS FOR DISCHARGE LAMPS

[76] Inventors: Michael S. Lathom, Rte. 1, Box 567, Clayton, Wash. 99110; Bruce B. Gullixson, 1513 W. Jackson, Spokane, Wash. 99205; Bruce P. Sweat, 3015 E. 16th, Spokane, Wash. 99203

[21] Appl. No.: 769,482

[22] Filed: Aug. 26, 1985

[51] Int. Cl.[4] ..... H05B 37/00; H05B 39/00; H05B 41/14

[52] U.S. Cl. ..... 315/227 R; 315/240; 315/244; 363/59; 363/63

[58] Field of Search ..... 315/227, 240–244; 320/1; 363/59, 60, 61, 63

[56] References Cited

U.S. PATENT DOCUMENTS

| | | | |
|---|---|---|---|
| 3,443,154 | 5/1969 | Hoekstra et al. | 315/240 |
| 3,579,026 | 5/1971 | Paget | 315/258 |
| 3,643,127 | 2/1972 | Laupman | 315/101 |
| 3,968,400 | 7/1976 | Weinreich | 315/240 |
| 4,132,925 | 1/1979 | Schmutzer et al. | 315/208 |
| 4,134,043 | 1/1979 | Nuver | 315/92 |
| 4,167,689 | 9/1979 | Quirke | 315/206 |
| 4,219,872 | 8/1980 | Engelmann | 363/126 |
| 4,230,971 | 10/1980 | Gerhard et al. | 315/307 |
| 4,260,932 | 4/1981 | Johnson | 315/205 |
| 4,289,993 | 9/1981 | Harper et al. | 315/311 |
| 4,337,417 | 6/1982 | Johnson | 315/290 |
| 4,340,843 | 7/1982 | Anderson | 315/205 |
| 4,366,570 | 12/1982 | Bees | 320/1 |
| 4,406,976 | 9/1983 | Wisbey et al. | 315/309 |
| 4,555,647 | 11/1985 | Leskovec et al. | 315/197 |

*Primary Examiner*—Saxfield Chatmon
*Assistant Examiner*—Michael Razavi
*Attorney, Agent, or Firm*—Wells, St. John & Roberts

[57] ABSTRACT

Ballast and starting circuits for controlling current and voltage applied to an electrical dishcarge lamp. The ballast circuits use positive and negative capacitors which are alternately charged and discharged in an asychronous manner. The positively charged capacitors are charged during positive portions of alternating current and discharged during negative portions of the alternating current. The negatively charged capacitors are charged during negative portions of the alternating current and discharged during positive portions. Transistors or other appropriate switching means are used to switch the capacitors to the lamp during discharge thereof. Startup circuits are included for boosting the voltage applied to the lamp either manually or automatically upon startup. A startup regulator circuit is also shown for controlling current flow during periods of high current demand such as during startup.

84 Claims, 8 Drawing Sheets

SWITCHED CAPACITIVE BALLASTS FOR DISCHARGE LAMPS

TECHNICAL FIELD

The technical field of this invention is ballast circuits for controlling current flow through electrical discharge lamps.

BACKGROUND OF THE INVENTION

Electrical discharge lamps are widely used in various forms, such as fluorescent lights, neon lights, mercury vapor lights and sodium vapor lights. These and many other types of electrical discharge lamps are known and possible using technology which began in the 1800's when many scientists experimented with electrical discharge lamps.

Electrical discharge lamps are characterized by an envelope of glass or other transparent material which encloses a volume of appropriate gas. The enclosed gas can be of a variety of types and combinations which are capable of being ionized to allow electrical current to flow therethrough. Examples of suitable gases employed in electrical discharge lamps include air, neon and argon. These gases are often combined with small quantities of suitable metals and other materials which improve the ionization or light emissive properties of the lamp. Examples of metals commonly used in discharge lamps are sodium and mercury, which vaporize as a result of the heat generated by the lamps. Discharge lamps are also manufactured using combinations of gases such as neon and argon with metal halides such as mercury iodide and sodium iodide.

The variety of gases and added materials used in discharge lamps have widely varying voltage requirements for initiating ionization. The voltage or potential required across the electrodes before ionization will occur depends upon the gas type, internal pressure of the gas, gas temperature, and electrode spacing. After the gas within a discharge lamp becomes ionized, current flows more readily because of the increased number and density of available charge carriers. The increased number of charge carriers greatly reduces the resistance across the electrodes as compared to the starting resistance required when initiating ionization. This decrease in the electrical resistance across the lamp electrodes requires that some form of current limiting device be used in conjunction with the discharge lamp to control the flow of current and prevent the destructive amounts of heat which would be caused thereby. Current control is also desired to reduce power consumption and optimize the illumination output of the lamp. This current limiting function for discharge lamps has typically been performed by an electrical device termed a ballast.

Prior art discharge lamp ballasts have typically used a transformer or other induction coil between the source of electricity and the discharge lamp in order to limit current flow through the lamp. Such transformer ballasts have also often been used to boost the starting voltage to the lamp. Such prior art inductive ballasts suffer from a number of disadvantages. Transformers are relatively costly to manufacture and are also relatively large and heavy. This increases the total cost of the discharge lamp and further requires that relatively strong standards, poles, overhanging arms and other supporting structures be employed. Increased size and strength for foundations and other structural members must also accordingly be provided.

It has also not been practical to remotely mount transformer ballasts at the base of a light pole or otherwise in a remote location because of the relatively high starting or ionization voltage required. Supplying such starting potential has been difficult or impossible to attain when lengths of wire greater than 25–30 feet have been used because of line losses and voltage decreases occurring due to capacitance developed across the supply wiring. Accordingly, it has been standard practice to mount the heavy, bulky transformers immediately adjacent the lamp.

The close mounting of inductive ballasts to discharge lamps typically causes very significant increases in installation and maintenance costs. Installation costs are increased because of the increased size and structural capability which must be provided in any light fixture and supporting structure. Placement of such heavy ballasts in street lighting and other applications also usually entail an overhanging configuration in the added weight of the ballasts which further increase the demands placed upon the supporting poles and other structural elements. Since these poles and other supporting structures are often tall, slender, and free standing, the incremental weight of the inductive ballasts require a disproportionately large amount of the installation costs. Further aggravating these basic structural problems are the effects of wind upon light standards. The large size of the ballasts and associated hoods are more easily displaced by wind forces striking the units atop typically slender light standards, thus displacing the load further off center and intensifying the structural loading problem associated with the weight of the ballasts.

Inductive ballasts must also be shielded from the wind and weather thus requiring additional expense for protective hoods or other coverings. Such protective hoods are relatively large thus increasing the wind loading and weight placed upon the structure which still further increases the costs of manufacturing and installation.

The installation costs of discharge lamp lighting is further increased when transformer ballasts are used because of the relatively high costs of crating, shipping and handling the heavy and bulky transformer. Manufacture of such transformer ballasts also requires relatively large scale heavy industry in order to produce economically. The materials and costs of constructing inductive ballasts are accordingly high.

Maintenance of transformer ballasts has also proven to be costly and difficult. Transformer ballasts produce substantial amounts of heat which tend to deteriorate the coil winding insulation thus leading to short circuiting of the coils and replacement of the ballast. Since the transformer ballasts cannot be conveniently mounted in remote locations from the lamp, this often requires cranes in order to remove and replace deficient ballasts. This accordingly increases maintenance costs.

Vibration produced by transformer ballasts may also cause fluctuating or cyclical loading on the light fixture supporting structures which requires increased strength, or in some cases premature failure, resulting damage and maintenance costs. The expected service life of transformer ballasts is also sufficiently short for the above and other reasons so that maintenance must be performed on a regular basis where numerous units are in service.

Prior art transformer ballasts also suffer from a tendency to vibrate at 60 Hz and several upper harmonies thereof thus producing very noticeable and often irritating noise. This noise has restricted most types of discharge lamps to exterior uses only. Fluorescent type discharge lamps are widely used in interior applications because they do not produce as much noise as other more efficient types of discharge lamps which are noisier. Considering the widespread use of fluorescent lamps, this results in tremendous increased power costs for using fluorescent type lamps versus sodium vapor and other more efficient lamps.

Prior art inductive ballasts are also disadvantageous in providing an inductive power factor component. Power companies typically experience excess inductive as compared to capacitive reactive power factor components, thus requiring installation of power factor correcting equipment such as large banks of capacitors. Such equipment is expensive and accordingly increases the cost of power to the consumer. Thus there is a need for discharge lamp ballasts which produce a capacitive power factor which can be used to offset power consumed by inductive devices such as electric motors.

The prior art includes U.S. Pat. No. 4,337,417 to J. Johnson for a starting and operating apparatus for high-pressure sodium lamps. The Johnson apparatus uses an inductive ballast to control current flow. A dual capacitor arrangement is provided with current through blocking diodes to charge one of the capacitors to approximately double peak line voltage. A zener diode is used to gate a silicon controlled rectifier into a closed condition so that the high voltage charge on the highly charged capacitor flows through the inductor and provides a voltage peak used to start an associated high pressure sodium discharge lamp. The Johnson capacitor arrangement is used to start but does not control current flow through the lamp during normal operation.

U.S. Pat. No. 4,406,976 to Wisbey et al discloses a discharge lamp ballast circuit having an inductor and capacitor in series with two discharge lamps. A bidirectional gated switching device is used across the discharge lamps and controlled to discharge the series capacitor and increase voltage, thereby providing an adequate starting potential.

Methods and circuits for facilitating starting and flickerless operation of discharge lamps are disclosed in U.S. Pat. No. 4,260,932 to V. Johnson. The V. Johnson invention uses a voltage increasing capacitor arrangement to provide increased starting potential.

SUMMARY OF THE INVENTION

It is an object of the present invention to provide a current limiting ballast for discharge lamps which does not require a relatively large and costly inductor to be used in order to limit current flow through the discharge lamp.

It is another object of the invention to provide a ballast for discharge lamps which is relatively light in weight, economical to manufacture, and highly reliable.

It is a further object of this invention to provide a ballast for discharge lamps which can be remotely mounted away from the lamp being powered for ease of maintenance and decreased installation costs.

It is a still further object of the invention to provide a ballast for discharge lamps which provides a capacitive power factor which can be used to balance the general excess of inductive power factor.

It is another object of the invention to provide a discharge lamp ballast which generates less heat and vibration and has greater electrical efficiency as compared to conventional inductive ballasts.

Ballast circuits built according to this invention can accomplish some or all of the above objectives. A preferred form of the invention includes two capacitors or capacitor banks which are each connected to an incoming alternating current supply using blocking diodes or some other suitable means for dividing the positive and negative portions of the alternating current. One capacitor bank receives the positive portion of the alternating current and the other capacitor receives the negative portion. Switching means such as switching transistors are connected between the capacitors and the discharge lamp being powered. The switching means are asynchronously and alternately opened and closed, thereby alternately disconnecting and connecting the capacitors in order to discharge the capacitors through the lamp and provide power thereto. The switching means are controlled by a suitable switching control circuit which places the switches into an open mode during the associated positive or negative portions used to charge that respective capacitor. The switches are placed into a closed mode out of phase with the positive or negative portions of the cycle which that particular capacitor receives, thus isolating the lamp from line current. Current through the lamp is thus controlled by the capacitance of each capacitor bank and the extent to which they can be discharged during the period its associated switching means is closed.

Embodiments having manual and automatic starting circuits are also provided to boost voltage during startup. Preferred embodiments also include indicator lamps for improved diagnostic maintenance. Still further circuitry can be provided to regulate power flow to the main capacitors and through switching transistors to thus prevent excessive current loading during startup. Still further embodiments are provided with multiple voltage and wattage capabilities using alternate jumper connectors.

Benefits of the invention can include lower power loss, physical lightness, reduced noise and interference, compactness, remote locatability, low heat output, lower cost mounting structures, lower expense of manufacture, lower freight costs, and capacitive power factor. Some or all of these, and other benefits of the invention which may be recognized below or in the future, may be accomplished using ballast circuits according to this invention. Exemplary preferred forms of the invention will be described below.

BRIEF DESCRIPTION OF THE DRAWINGS

Preferred embodiments of the invention are shown in the accompanying drawings in which.

DETAILED DESCRIPTION OF THE PREFERRED EMBODIMENT

In compliance with the constitutional purpose of the Patent Laws "to promote the progress of science and useful arts" (Article 1, Section 8), applicant submits the following disclosure of the invention.

Figure 1:
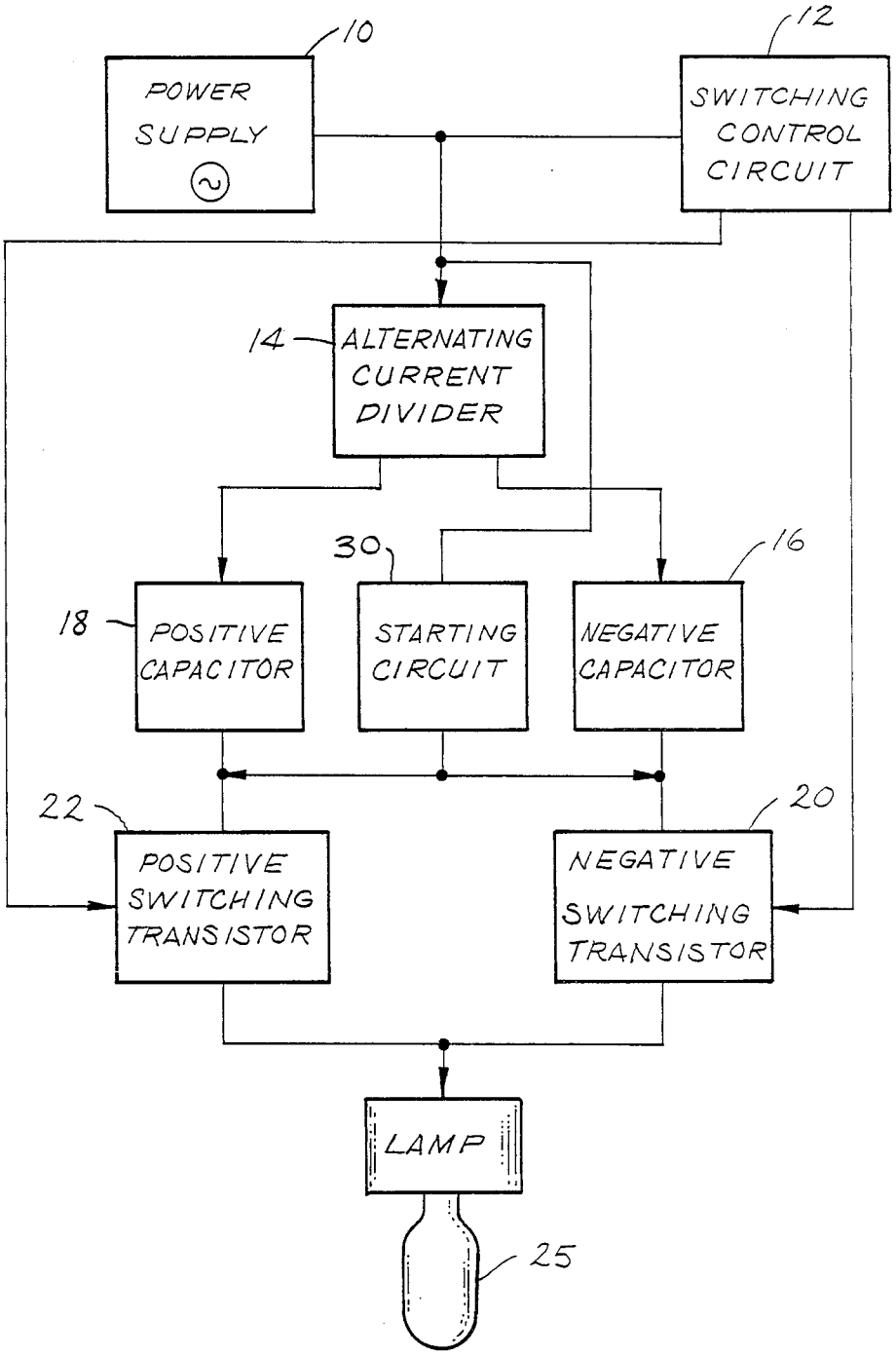
FIG. 1 is a block diagram showing the principal functional elements of basic forms of the invention.

FIG. 1 shows a basic conceptual model of the fundamental functional elements of preferred embodiments of this invention. An alternating current power supply 10 provides power to a switching control circuit 12 and to a suitable circuit 14 for dividing the alternating current into separate positive and negative current flows. The negative and positive current flows are separately supplied to negative and positive capacitors 16 and 18, respectively. Positive capacitor 18 is charged during positive portions of the alternating current. Negative capacitor 16 is charged during negative portions of the alternating current. Each capacitor is charged directly out of phase with the other in an alternating manner.

Negative capacitor 16 is controllably discharged through negative switching transistor 20 to lamp 25 during positive portions of the alternating current, while positive capacitor 18 is charged. Positive capacitor 18 is controllably discharged through positive switching transistor 22 to lamp 25 during negative portions of the alternating current, while negative capacitor 16 is being charged. The capacitors 16 and 18 are thus alternately charged and then discharged through lamp 25 in a complementary asynchronous manner.

FIG. 1 also shows a starting circuit 30 which is used to boost the voltage applied through either or both positive or negative switching means 22 and 20, respectively. Starting circuit 30 is only used for a relatively short period of time during and immediately after initially supplying current from power supply 10 to starting circuit 30 and lamp 25.

Figure 2:
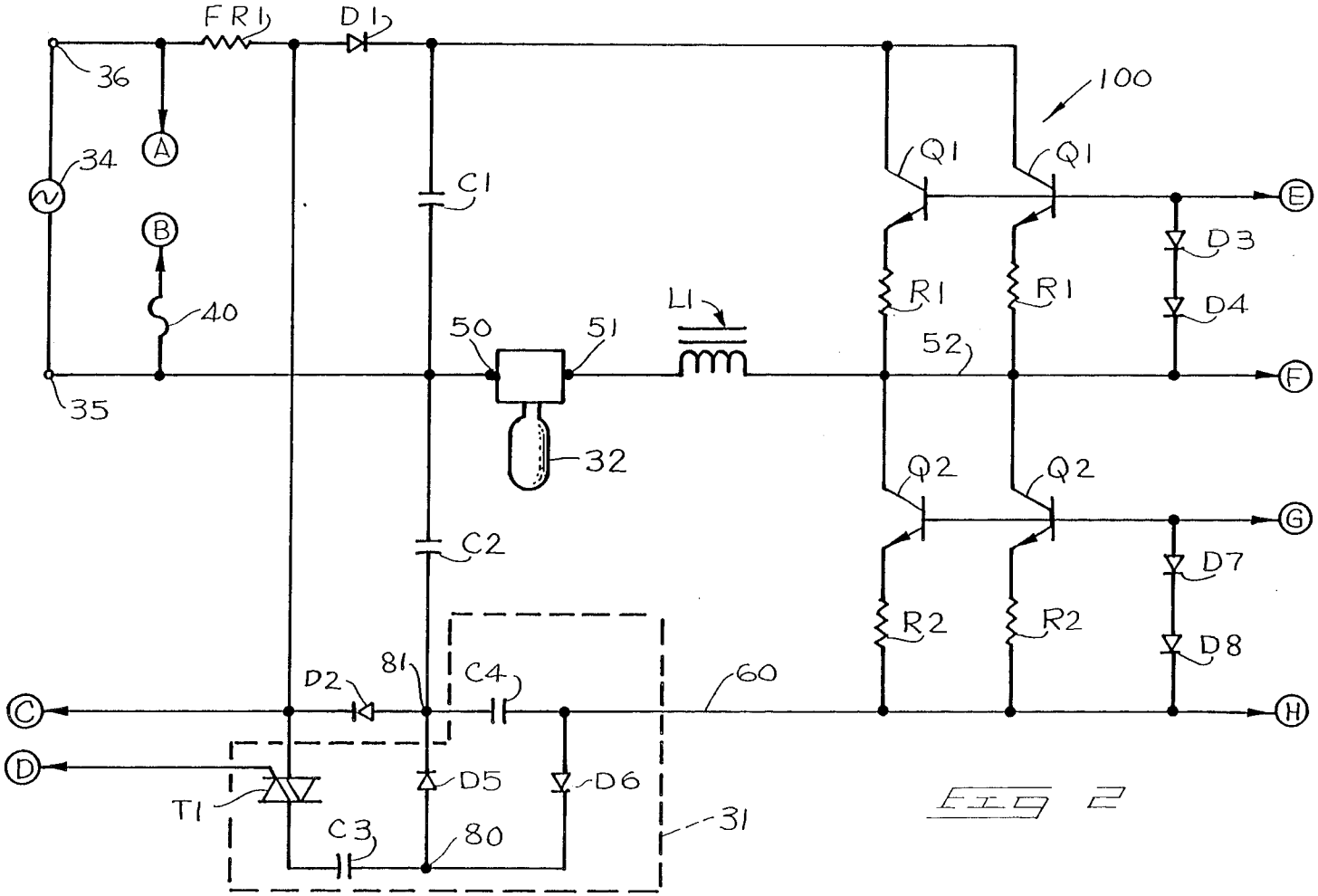
FIG. 2 is a schematic circuit diagram of a portion of a preferred circuit according to this invention.

FIG. 2 shows a portion of a ballast and starting circuit 100 useful in powering a metal halide electrical discharge lamp 32 such as a 400 watt sodium iodide lamp. Power is supplied by an alternating current power supply 34, such as a nominal 120 volt, 60 Hz line current used widely in the U.S. Power supply 34 is advantageously connected with terminal 35 as neutral and terminal 36 as the hot terminal at which voltage swings from approximately −170 volts to +170 volts in a typical 120 volt rms sinusoidal cycle. The period during which the potential of terminal 36 is positive with respect to terminal 35 is termed the positive potential portion. The period during which the potential of terminal 36 is negative with respect to terminal 35 is termed the negative potential portion. Together one positive and one negative potential portions essentially comprise a single alternating current cycle.

Figure 3:
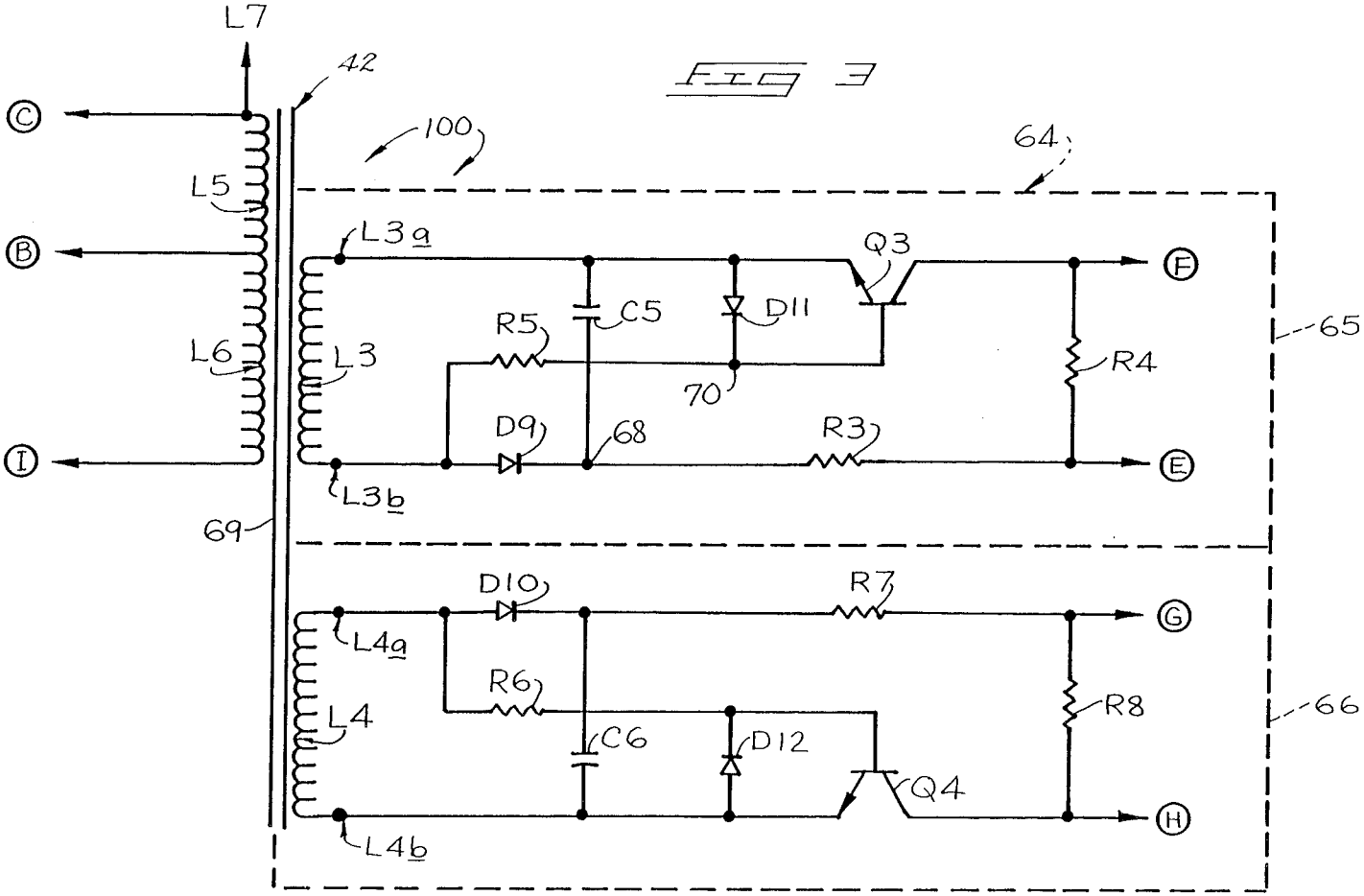
FIG. 3 is a schematic circuit diagram of a further portion of the preferred embodiment shown in FIG. 2.
Figure 4:
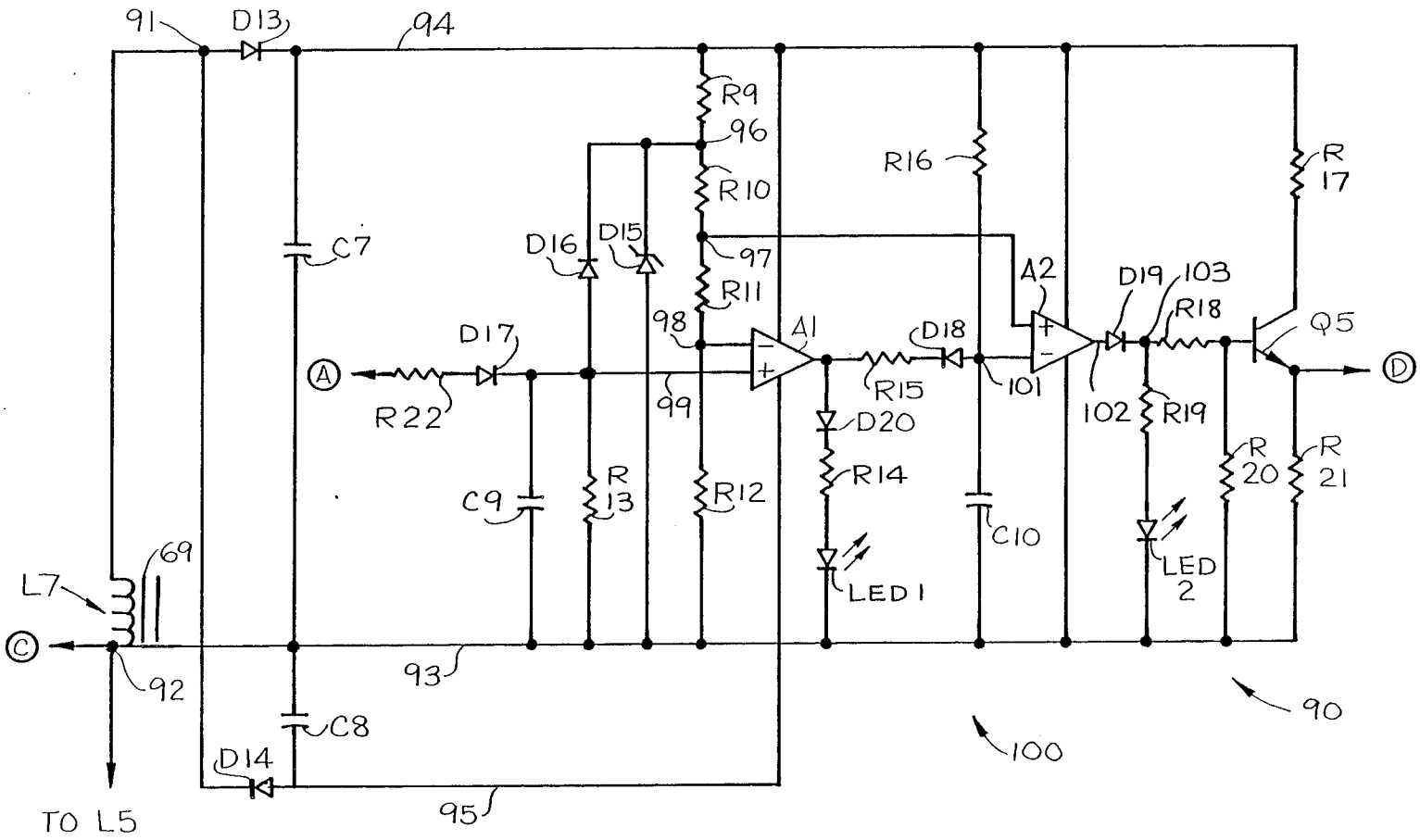
FIG. 4 is a schematic circuit diagram of a further portion of the preferred embodiment shown in FIGS. 2 and 3.

Letter A designates a connection of the line voltage to control portions of the circuit shown in FIG. 4. A fusable surge resistor FR1 is advantageously provided between line voltage and remaining components of circuit 100. A thermal circuit breaker or cutout 40 can advantageously be included between terminal 35 and terminal B of transformer 42 of FIG. 3.

The alternating current (a-c) output from fusable resistor FR1 is supplied to two blocking diodes LD1 and D2. Blocking diode D1 is oriented with anode toward line voltage in order to pass positive current to one side of capacitor C1. Diode D2 is oppositely oriented to pass negative current to one side of capacitor C2. The configuration of diodes D1 and D2 thus divides the alternating current from supply 34 into a positive component going to capacitor C1 and a negative component going to capacitor C2. Capacitors C1 and C2 can be any suitable storage means. It has been found preferable not to use electrolytic capacitors. The opposite sides of capacitors C1 and C2 are connected to neutral terminal 35 which is also connected to terminal 50 of lamp 32.

The positively charged side of capacitor C1 is connected to a first electrical switching means such as switching transistors Q1 connected in parallel. Switching transistors Q1 are placed in a closed or conductive mode by applying a positive emitter to base bias voltage. Base voltage for switching transistors Q1 is provided by connecting to a positive switching control circuit 65 at conductor E of FIG. 3.

Switching transistors Q1 are controlled by switching control circuit 65 so as to only be biased into a closed mode during negative portions of the alternating current power supplied by current supply 34. This assures that there is no direct application of line current to lamp 32 through switching transistors Q1. This arrangement allows current flow to lamp 32 to be limited to the available charge on capacitor C1 during any particular negative portion of the alternating current cycle.

Resistors R1 are provided between the emitters of transistors Q1 and conductor 52 to provide an appropriate potential drop between the emitters of Q1 and conductor 52. Diodes D3 and D4 are provided in series between the bases of transistors Q1 and conductor 52 in order to protect against excessive emitter to base biasing voltage and allow flow of current from conductor E to conductor F as generated by switching control circuit 65.

The negatively charged side of negative capacitor C2 is connected to lamp 32 through a second electrical switching means such as switching transistors Q2 connected in parallel. Switching transistors Q2 are placed in a closed or conductive mode by applying a positive emitter to base bias voltage. Base voltage for switching transistors Q2 is provided by connecting to conductor G of FIG. 3.

Switching transistors Q2 are only biased into a closed mode during positive portions of the alternating current power supply so that there is no direct application of line current to switching transistors Q2. This arrangement allows current flow to lamp 32 to be limited to the available negative charge on capacitor C2 during any particular positive portion of the alternating current cycle because of the blocking action of diode D2 to positive current flow. Additional starting voltage is, however, provided by starting circuit 31 as will be explained below.

Resistors R2 are provided between the emitters of transistors Q2 in order to provide an appropriate potential drop therebetween. Negative charge form capacitor C2 passes through blocking diodes D5 and D6 which are used in the starting subcircuit explained below. Diodes D7 and D8 are provided in series between the base of transistors Q2 and conductor 60 to prevent excessive biasing voltage and to allow current flow in switching control circuit 66 of FIG. 3.

An induction coil or choke L1 is advantageously provided between conductor 52 and lamp 32 to smooth voltage spikes in the power provided from switching transistors Q1 and Q2, since the switching of Q1 and Q2 causes some voltage spikes to occur.

FIG. 3 shows a preferred switching control circuit 64 for providing control signals which control the asynchronous operation of switching means Q1 and Q2. Switching control circuit 64 can be any one of a variety of appropriate circuits for detecting the phase of the alternating current power supply and providing appropriate biasing potentials to switching means Q1 and Q2 such as at terminals E, F, G and H, respectively.

Switching control circuit 64 is advantageously divided into a first or positive switching control subcircuit 65 and a second or negative switching control subcircuit 66. Positive switching control subcircuit 65 provides voltage across terminals E and F which biases switching transistors Q1 into a conductive mode during negative portions of the alternating current. When switching means Q1 are in the conductive mode, positively charged capacitor C1 discharges therethrough and the discharging current is conducted through resistors R1, conductor 52 and choke L1 to power lamp 32.

Positive switching control circuit 65 also effectively reverse biases positive switching means Q1 during positive portions of the alternating current from 34, thereby placing switching means Q1 into a nonconductive mode when line voltage is positive and capacitor C1 is being positively charged. The nonconductive mode of Q1 prevents excessive current from flowing to lamp 32 which would otherwise occur by direct connection of line to lamp 32.

Negative switching control 66 functions similarly to positive switching control 65 but in a complementary asynchronous manner. Switching control 66 provides voltage across terminals G and H which biases switching transistors Q2 into a conductive mode during positive portions of the alternating current. When switching means Q2 are in the conductive mode, negatively charged capacitor C2 discharges through diodes D5 and D6, resistors R2, switching transistors Q2, and choke L1 to power lamp 32.

Negative switching control 66 also effectively reverse biases negative switching means Q2 during negative portions of the alternating current supply by source 34, thereby placing switching means Q2 into a nonconductive mode when line voltage is negative and capacitor C2 is being negatively charged. The nonconductive mode of Q2 prevents excessive current from flowing to lamp 32 which would otherwise occur by direct connection of line to lamp 32.

FIG. 3 shows one specific form of circuit which can be used as positive switching control 65. Such circuit includes an inductive coil L3 which senses the phase of the incoming line voltage through transformer core 69. Transformer core 69 is shared with coil L5 which is connected across the incoming line voltage. The induced voltage in coil L3 swings positive and negative depending on line voltage from current source 34.

The first side L3*a* of coil L3 is connected to the first plate of capacitor C5, the anode of blocking diode D11, and to the emitter of transistor Q3. The opposite or second side L3*a* of coil L3 is connected to a resistor R5 and the anode of blocking diode D9. Resistor R5 is also connected to the cathode of diode D11 and the base of transistor Q3. The cathode of diode D9 is connected to the second plate of capacitor C5 and to resistor R3. The opposite side of resistor R3 is connected to terminal or conductor E which is further connected to the bases of switching transistors Q1. The collector of transistor Q3 is connected to F and conductor 52 of FIG. 2. A resistor R4 is connected between the collector of Q3 and conductor E.

During positive portions of the a-c line voltage, the voltage induced across coil L3 creates a positive voltage at terminal L3*a* and a negative voltage at terminal L3*b*. The positive voltage at L3*a* is supplied to the emitter of transistor Q3 and the first plate of capacitor C5. Positive current flows through diode D11, resistor R5 and to negative terminal L3*b* to reverse bias transistor Q3 into a nonconductive mode. Resistor R4 allows the potential across conductors E and F to be equal, thus effectively biasing switching transistors Q1 into a nonconductive mode so that positive capacitor C1 is charged and direct line current is not applied to lamp 32.

When the alternating current goes into a negative portion of the a-c cycle then L3*b* is relatively positive with respect to L3*a*. The greater voltage thereat flows through resistor R5 to forwardly bias transistor Q3 into a conductive mode. Positive current from the L3*b* side of coil L3 also flows through diode D9, resistor R3 and forwardly biases switching transistors Q1 into the conductive mode thereby discharging capacitor C1 therethrough to lamp 32. Excess current supplied through resistor R3 is passed through diodes D3 and D4 and back through transistor Q3 to the L3*a* side of coil L3.

FIG. 3 also shows one specific form of circuit which can be used as negative switching control 66. Such circuit is conceptually similar to switching control 65. Switching control 66 includes an inductive coil L4 also on core 69 and having a first side L4*a* and second side L4*b*.

The first side of coil L4 is connected to resistor R6 and the anode of blocking diode D10. The second side L4*b* is connected to one side of capacitor C6, the anode of blocking diode D12 and the emitter of transistor Q4. The opposite side of capacitor C6 is connected to the cathode of diode D10 and to one side of resistor R7. The opposite side of R7 is connected to conductor G and the bases of switching transistors Q2. Resistor R6 is also connected to the cathode of blocking diode D12 and to the base of transistor Q4. The collector of transistor Q4 is connected to conductor H and to conductor 60 of FIG. 2. A resistor R8 is connected between conkductors G and H.

During positive portions of the a-c voltage, the voltage induced across coil L4 creates a positive voltage at L4*a* and a negative voltage at L4*b*. The relatively positive voltage at L4*a* passes through resistor R6 and forwardly biases transistor Q4 into a conductive mode. Positive current also flows from side L4*a* through diode D10, resistor R7 to forwardly bias switching transistors Q2, allowing discharge of capacitor C2 through lamp 32. Excess current through resistor R2 passes through diodes D7 and D8 and back through transistor Q4.

During negative portions of line a-c the first side L4*a* is negative relative to side L4*b*. Negative current flows from L4*a* and increases potential through resistor R6 and diode D12 to reverse bias transistor Q4 into a nonconductive mode. Resistor R8 allows terminals G and H to achieve an approximately equal voltage which effectively biases switching means Q2 into a nonconductive mode thus preventing the negative line voltage from being directly connected to lamp 32, and also allowing capacitor C2 to be negatively charged.

From the above discussion it is apparent that switching control circuit 64 controls switching means Q1 and Q2 so that capacitors C1 and C2 are alternately charged and discharged through Q1 and Q2 so that current flow to lamp 32 is limited by the capacitance of capacitors C1 and C2. This prevents excessive current flow through lamp 32 after startup when the resistance across the lamp has been reduced by the greater concentration of ions within lamp 32. At startup the resistance across lamp 32 is relatively higher thus requiring a relatively higher voltage to achieve ionization of the particular gas used in lamp 32. However, this voltage increase is not needed wwhen optimal efficiency is desired during normal operation. Accordingly, it is desirable to include a suitable starting circuit to temporarily boost the voltage applied to lamp 32.

FIG., 2 shows a starting circuit 31 useful as part of circuit 100 to power 120 volt metal halide lamps. Starting circuit 31 includes a triac or other suitable bidirectional switching device T1. Triac T1 has its main terminal one connected to the unrectified incoming line current coming from fusable surge resistor FR1. The gate of triac T1 is connected to a connector D which communicates a triac gating signal from the general control circuit 90 shown in FIG. 4 and hereinafter described. The main terminal two of triac T1 is connected to a first side of a capacitor C3. The opposite second side of capacitor C3 is connected to node 80 between the anode of blocking diode D5 and the cathode of blocking diode D6. The cathode of diode D5 is connected at node 81 to the anode of diode D2, a first side of negative capacitor C2, and a first side of capacitor C4. The opposite second side of capacitor C4 is connected to the anode of diode D6, and to conductor 60 which is connected through resistors R2 to negative switching means Q2.

Starting circuit 31 operates in ballast and starting circuit 100 in the following manner. Soon after initiating current to circuit 100 the generalized control circuit 90 of FIG. 4 provides a gating control signal at conductor D which activates triac T1 and allows current to flow therethrough. A positive portion of the line a-c flows through triac T1 and positively charges the first side of capacitor C3. The following negative portion of the alternating current causes the first side of capacitor C2 to be negatively charged and forces the previous voltage differential across capacitor C3, thereby lowering the potential at node 80 below peak negative line voltage. Blocking diode D6 allows the negative voltage at node 80 to be conducted to one side of capacitor C4. Capacitor C4 holds the increased negative voltage until the next positive cycle. The following positive portion of the alternating current causes negative switching transistors Q2 to close thus discharging the increased negative charge on capacitor C4 through to lamp 32. The simultaneous positive charging of the first side of capacitor C3 further induces additional negative charge from the second side of capacitor C2. Repeated cycling of starting circuit 31 may be needed to achieve a voltage value sufficient to start lamp 32, such as approximately three times line voltage or 510 volts peak. The negative charge on capacitor C2 also discharges through diodes D5 and D6 and transistors Q2 to lamp 32. Starting circuit 31 boosts the negative voltage supplied through switching transistors Q2 until the gating control signal from D is terminated.

The starting control and diagnostic circuit 90 shown in FIG. 4 will now be described. Starting control and diagnostic circuit 90 is used to generate an appropriate gating control signal at D in order to operate starting circuit 31 during an appropriate startup period, such as, for instance, 30 seconds to several minutes. During this startup period, the particular discharge lamp type being used achieves a sufficiently stable operation to continue without the boosted voltage provided by starting circuit 31 or an equivalent thereof. Starting control and diagnostic circuit 90 also provides diagnostic information on run and startup indicators explained below.

Starting control circuit 90 advantageously includes an induction coil L7 which shares core 69 with coil L5 thus providing circuit 90 with a supply of power at appropriate voltage and current values. Coil L7 as used with ballast 11 advantageously provides 6–8 volts and current of approximately ½ ampere. The first side of coil L7 is connected to node 91 and the second side to node 92. Node 92 is connected to conductor or terminal C which is connected to the output of surge resistor FR1.

The first side of coil L7 is connected to the anode of blocking diode D13 and to the cathode of blocking diode D14. Diodes D13 and D14 effectively divide the output of coil L7 into positive and negative components, respectively. Capacitor C7 is connected with a first side to the cathode of diode D13 and the second side to conductor 93 which is directly connected to node 92 and conductor C. Capacitor C8 is connected with a first side to the anode of diode D14 and a second side connected to conductor 93. Capacitors C7 and C8 smooth the respective positive and negative half wave currents passed by diodes D13 and D14. The resulting approximately positive and negative direct currents supplied by conductors 94 and 95 are used to power remaining components as described below.

Starting control and diagnostic circuit 90 includes a series of resistors R9–R12 connected between the positive power supplied by conductor 94 and the control ground potential existing on conductor 93. Each intermediate node 96–98 is accordingly at a decreasing voltage. Zener diode D15 is connected between node 96 and conductor 93 in order to accurately fix a reference voltage for nodes 96–98.

Operational amplifier A1 is used to compare the voltage on conductor 99 to the voltage at node 98. If the voltage on conductor 99 exceeds the voltage at node 98 then there is a substantial positive current output from A1. If the voltage on conductor 99 is less than the voltage at node 98 then there is substantial negative current output from A1.

The signal on conductor 99 originates at conductor A which is the incoming line voltage before surge resistor FR1. Conductor A is connected to resistor R22 to provide surge protection. The output from resistor R22 is connected to the anode of blocking diode D17. The cathode of diode D17 is connected to conductor 99. Capacitor C9 is connected between conductor 99 and conductor 93 to smooth the positive portion of line voltage which passes through diode D17. A relatively high resistance resistor R13 is also connected between conductors 99 and 93 to allow capacitor C9 to slowly discharge therethrough. During brief power interruptions, such as less than 1 second in duration, capacitor C9 keeps the signal in conductor 99 sufficiently high to maintain continued operation. Blocking diode D16 assures that excessive positive voltages are not developed on conductor 99 by passing such through zener diode D15 to conductor 93.

The output from comparative operational amplifier A1 is connected to the anode of blocking diode D20 and to one side of resistor R15. The other side of resistor R15 is connected to the cathode of blocking diode D18. The anode of diode D18 is connected to node 101. The cathode of blocking diode D20 is connected in series with resistor R14 and light emitting diode LED 1 to connector 93. A positive output from A1 thus passes through D20, R14 and lights LED 1 to indicate that power is being used by lamp 32 as will be explained more fully below.

Starting control and diagnostic circuit 90 also includes a second comparative operational amplifier A2. One input to A2 is connected to an appropriate reference voltage developed at node 97. The other input to A2 is connected to node 101 which is typically provided with a positive voltage from conductor 94 through a high resistance value resistor R16. Node 101 is also connected to one side of a capacitor C10. The other side of capacitor C10 is connected to conductor 93.

Amplifier A2 controllably provides an output signal along conductor 102 which is connected to the anode of blocking diode D19 allowing positive output to pass therethrough to node 103. Node 103 is connected in series to resistor R19, light emitting diode LED 2, and conductor 93. Node 103 is also connected to one side of resistor R18, the other side of which is connected to the base of a switching device such as transistor Q5. A resistor R20 is connected between the base of Q5 and conductor 93.

The collector of transistor Q5 is connected to conductor 94 through resistor R17. The emitter of transistor Q5 is connected to conductor D which carries the starting circuit control signal to starting circuit 31. The emitter of transistor Q5 is also connected to conductor 93 through resistor R21.

The operation of starting control and diagnostic circuit 90 will now be fully described. During the initial phases of startup, the amount of current flowing through resistor FR1 are small because lamp 32 has not fired, thus keeping the voltage drop thereacross small. The voltage supplied at C is thus very close to the voltage at A resulting in inputs to amplifier A1 which are approximately equal, or with anode 98 somewhat lower. This produces not output from A1 and LED 1 is not initially illuminated, thus indicating that lamp 32 has not started.

Also upon initial startup, positive current flows through conductor 94, and resistor 16 to begin charging capacitor C10. The amount of charge developed on C10 does not increase at a substantial rate until the output from amplifier A1 becomes positive as a result of lamp ignition.

With firing of lamp 32 and the increased current flow therethrough, a substantial voltage drop occurs across surge resistor FR1 thus increasing the relative voltage at A as compared to C. The increased voltage at A increases the voltage in conductor 99 and causes the output of A1 to go positive thus lighting LED 1 which acts as an indicator light that lamp 32 is functioning. The positive output from A1 creates a potential at the cathode of blocking diode D18 which prevents leakage therethrough, and directs substantially all current passing through resistor R16 to charge capacitor C10.

Amplifier A2 receives a relatively fixed voltage input from node 97. Initially, the secondary input from node 101 is at a relatively lower potential since capacitor C10 is not yet charged due to the delay required to fire the lamp and the small current passed through resistor R16. Thus, during this initial startup period A2 produces a positive output signal to conductor 102. The positive, output signal passes through diode D19, resistor R19 and lights LED 2 which acts as a indicator light for the startup period. The output from A2 also biases transistor Q5 into a conductive mode and a startup control signal is sent to triac T1 via conductor D, thus creating the desired startup voltage for lamp 32 as explained above.

After an appropriate period of time, capacitor C10 becomes sufficiently charged so that the voltage at node 101 exceeds the voltage at node 97. This causes the output from amplifier A2 to go negative thus terminating the operation of LED 2 and zero biasing transistor Q5 thus stopping the startup control signal to triac T1. The voltage drop across surge resistor FR1 continues with substantial current flow through lamp 32 continuing the illumination of LED 1 to indicate lamp operation even though the startup period indicator LED 2 is no longer illuminated. The operational sequence described above for circuit 90 is repeated each time startup of lamp 32 is required.

The preferred circuit 100 according to this invention as described herein and illustrated in FIGS. 2–4 is advantageously constructed for use as a ballast with nominal 120 volt, 400 watt metal halide discharge lamps currently available in the U.S. The values of components listed below in TABLE I are believed most advantageous for such application, although there will be many alternative values and circuit modifications and equivalents which will be obvious to those skilled in the art.

TABLE I

| | | |
|---|---|---|
| RESISTORS | | |
| FR1 | 0.2 | ohm |
| R1, R2 | 0.22 | |
| R3 | 8.2 | ohm |
| R4 | 100 | ohm |
| R5 | 200 | ohm |
| R6 | 220 | ohm |
| R7 | 8.2 | ohm |
| R8 | 100 | ohm |
| R9 | 1K | ohm |
| R10–R12 | 10K | ohm |
| R13 | 10M | ohm |
| R14 | 10M | ohm |
| R15 | 820 | ohm |
| R15 | 1K | ohm |
| R16 | 30M | ohm |
| R17 | 68 | ohm |
| R18 | 1K | ohm |
| R19 | 820 | ohm |
| R20 | 10K | ohm |
| R21 | 330 | ohm |
| R22 | 10K | ohm |
| CAPACITORS | | |
| C1 | 330 | microfarads |
| C2 | 330 | microfarads |
| C3 | 30 | microfarads |
| C4 | 10 | microfarads |
| C5, C6 | 1000 | microfarads |
| C7 | 470 | microfarads |
| C8 | 100 | microfarads |
| C9 | 0.1 | microfarads |
| C10 | 0.47 | microfarads |
| INDUCTORS | | |
| L1 | 5 | millihenries |

Figure 5:
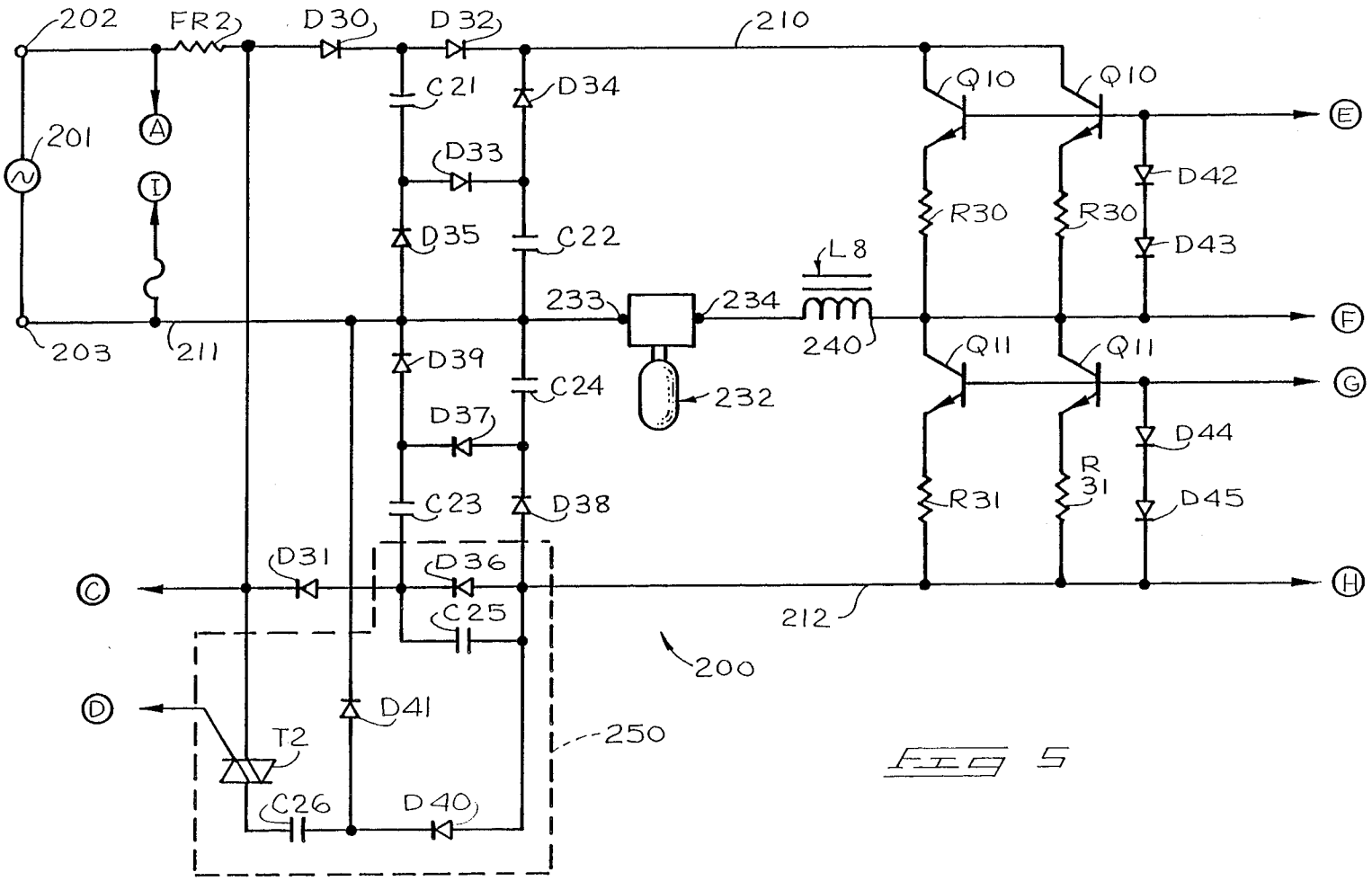
FIG. 5 is a schematic diagram of an alternative embodiment to the portion shown in FIG. 2.

FIG. 5 shows an alternative circuit 200 which can be used in lieu of the circuit shown in FIG. 2 in conjunction with the circuitry shown in FIGS. 3 and 4 to produce a switched capacitive ballast which can be used with nominal 240 volt a-c power for 400 watt metal halide discharge lamps. The conductors or terminals lettered A, C, D, E, F, G, H, and I connect with the circuits of FIGS. 3 and 4 at the similarly designated points in a manner similar to the circuit shown in FIG. 2 and described above.

A source of alternating current 201 is connected across terminals 202 and 203. Typically the neutral or common side of current source 201 is connected to terminal 203 and the hot or voltage varying side is connected to terminal 202. A fusable surge resistor FR2 is placed in series between incoming line voltage and conductor C.

Circuit 200 includes a first or positive rectifying means such as blocking diode D30 which is connected with the anode to surge resistor FR2. Blocking diode D30 passes only the positive portions of the incoming alternating current therethrough. Circuit 200 is also provided with a second or negative rectifier such as blocking diode D31. Diode D31 is oppositely oriented with its cathode connected to incoming current from source 201 so that only negative portions thereof are passed therethrough.

Circuit 200 includes positive charge storage means such as capacitors C21 and C22. Capacitor C21 has a first side connected to the output or cathode of diode D30 to receive positive current therefrom. The cathode of diode D30 and the first side of capacitor C21 are also connected to the anode of blocking diode D32. The cathode of diode D32 is connected to conductor 210. The second side of capacitor C21 is connected to the anode of blocking diode D33 and to the cathode of blocking diode D35. The anode of diode D35 is connected to conductor 211 which connects to terminal 203. The cathode of diode D33 is connected to a first side of capacitor C22 and to the anode of blocking diode D34. The cathode of diode 34 is connected to conductor 210. The second side of capacitor C22 is connected to conductor 211. Conductor 211 is also connected to one side or electrode of discharge lamp 232 at terminal 233.

This arrangement of diodes D32–D35 and capacitors C21 and C22 allows capacitors C21 and C22 to be charged in series and discharged in parallel, During charging, incoming positive portions of the supply current from source 201 pass through diode D30 to the first side of capacitor C21. Positive charge is also conveyed through diode D33 to charge the first side of capacitor C22 in series with C21. The voltages across capacitors C21 and C22 are shared according to well known electrical principals.

During discharge of capacitors C21 and C22, the preferably equally shared voltage is concurrently directed onto line 210 in parallel. Capacitor C21 discharges through diode D32 and capacitor C22 discharges through diode D34. Diode D33 isolates the first side of C22 from the second side of C21 during discharge. This arrangement for the positive charge storage means is advantageous where lamp 232 does not require operating voltages which would otherwise be achieved by direct connection of a single capacitor between line 210 and line 211, similar to the circuit of FIG. 2.

Circuit 200 also includes a negative charge storage means such as capacitors C23 and C24. The first side of capacitor C23 is connected to the output or anode of rectifying diode D31. The opposite or second side of capacitor C23 is connected to the anode of blocking diode D39 and to the cathode of blocking diode D37. The cathode of diode D39 is connected to conductor 211. The anode of diode D31 is connected to the cathode of diode D36. The anode of diode D36 is connected to conductor 212 and to the anode of blocking diode D38. The cathode of diode D38 is connected to the anode of diode D37 and to the first side of capacitor C24. The second side of capacitor C24 is connected to conductor 211. This arrangement of capacitors C23 and C24 and diodes D36–D39 also allows capacitors C23 and C24 to be charged in series and discharged in parallel. Description of the similar operation of capacitors C21 and C22 is given above and will not be repeated for C23 and c24.

Positive conductor 210 is connected to a positive switching means such as switching transistors Q10 which are in parallel with collectors of each connected to conductor 210. The bases of switching transistors Q10 are also connected in parallel to conductor E which is connected to positive switching control circuit 65 of FIG. 3 which provides a switching control signal as described above.

The emitters of switching means Q10 are connected through parallel resistors R30 to conductor F. Conductor F is connected to positive switching control circuit 65 as described above with respect to FIG. 3. Conductor F is also connected to an inductive coil or choke 240 which smooths the power supplied therethrough to terminal 234 of discharge lamp 232. Blocking diodes D42 and D43 are connected in series between the parallel bases of switching transistors Q10 and conductor F to allow excess biasing control current to flow therethrough.

Negative conductor 212 is similarly connected to a negative switching means such as switching transistors Q11. The emitters of switching transistors Q11 are connected in parallel through parallel resistors R31 to line 212. The bases of switching transistors Q11 are connected in parallel to conductor G which is connected to the negative switching control circuit 66 as shown in FIG. 3 and described above. Conductor 212 is directly connected to conductor H which is also connected to the negative switching control circuit 66 of FIG. 3. The collectors of switching transistors Q11 are connected in parallel via conductor F to choke 240 and lamp 232.

FIG. 5 further shows a starting circuit 250 which is used to increase the starting voltage applied across discharge lamp 232 during negative portions of the alternating current supplied by current source 201. Starting circuit 250 includes a triac T2 or similar electronic switching means. The main one terminal of triac T2 is connected to conductor C. The main two terminal of triac T2 is connected to a first side of capacitor C26. The gate terminal of triac T2 is connected to conductor D which provides a gating control signal such as described above and illustrated at FIG. 4.

The second side of capacitor C26 is connected to the cathode of blocking diode D40 and to the anode of blocking diode D41. The cathode of diode D41 is connected to conductor 211. The anode of diode D40 is connected to conductor 212. A capacitor C25 is connected in parallel with blocking diode D36 described above.

The operation of starting circuit 250 will be described in conjunction with the operation of remaining components of ballast circuit 200. Operation of circuit 200 is initiated by starting alternating current source 201 or by closing an appropriate switch (not shown). Initial starting of starting and control circuit 90 of FIG. 4 causes a gating control signal to be carried by conductor D to triac T2 thus placing the triac in a conductive mode. A negative portion of the alternating input current cause capacitors C23 and C24 to be charged in series. As the current swings positive capacitor C26 is charged with its first side positive and second side at common or ground potential because of connection to conductor 211 through blocking diode D41. As the input current swings negative again the voltage differential across capacitor C26 is increased because the first side of the capacitor must respond to the applied line voltage and the previous charge is not quickly dissipated. This effectively adds the voltage swing to the previous capacitor voltage differential. In the nominal 240 volt circuit described in FIG. 5 the voltage across C26 is changed from −340 volts to approximately −680 volts. This increased negative potential at the second side of capacitor C26 causes negative current to flow through blocking diode D40 to charge the second side of capacitor C25 to approximately −680 volts with respect to ground, in series with capacitors C23 and C24. The following positive cycle changes the potential on the first side of capacitor C23 from −340 volts to −170 volts with respect to ground. Capacitors C23 and C25 then discharge in series through transistors Q11 to lamp 232 providing approximately −510 volts. Several cycles of a-c current may be needed to bring the second side of capacitor C25 up to the −510 volts output desired. The specific voltage needed is dictated by the lamp being used. For a 400 watt metal halide lamp of common use in the United States, it is necessary to apply approximately 500 volts in order to arc the lamp for startup. Repeated arcing is necessary in most cases. Accordingly, capacitor C25 is charged to about or somewhat more negative potential than −500 volts at its second side and then is discharged during positive portions when switching transistors Q11 are conductive. This boosted startup voltage on the negative side of circuit 200 allows lamp 232 to be started.

Upon startup the gas or gases contained in a discharge lamp become ionized and the resistance across the lamp decreases and increased current begins to flow therethrough. The general control circuit 90 senses the increased current flow via the substantial voltage drop across surge resistor FR2. This causes the output from operational amplifier A1 to go high and light LED 1, which indicates that the discharge lamp is drawing current. The outputs from amplifier A1 causes the startup period defined by resistor R16 and capacitor C10 to begin. When capacitor C10 is sufficiently charged the output of amplifier A2 goes low and the gating control signal from the emitter of transistor Q5 onto conductor D also goes low thus placing triac T2 into a nonconductive mode, thus ending the startup period.

During and after the startup period, the positive capacitors C21 and C22 are charged in series during positive portions of the incoming alternating current. Capacitors C21 and C22 are discharged in parallel during negative portions of the alternating current. Capacitors C21 and C22 are charged in series and discharged in parallel because the voltage needed to properly operate discharge lamp 232 only requires less than ±170 volts after ionization has occurred. Thus the peak line voltage of 340 volts is not needed and is reduced using the series-parallel charging and discharging of capacitors C21 and C22.

Similarly, capacitors C23 and C24 are charged negatively in series during negative portions of the alternating current. Capacitors C23 and C24 are discharged in parallel during positive portions of the alternating current when switching transistors Q11 are biased into a conductive mode.

The alternating asynchronous operation of the positive and negative sides of circuit 200 allows current flow through lamp 232 to be limited to the charge which can be effectively discharged from positive capacitors C21 and C22 during negative portions, and negative capacitors C23 and C24 during positive portions of the power from alternating current supply 201.

The switching control circuits 64 described herein and shown in FIG. 3 are also used to control switching transistors Q10 and Q11 in a manner the same as described for switching transistors Q1 and Q2, above, and will not be repeated here for circuit 200 since the operation is the same. Similarly the general control circuit 90 is also connected to circuit 200 as indicated in the FIGS. in an analogous way to its use with the circuit of FIG. 2. Operation is equivalent to the description given with respect thereto.

Table II shown below gives preferred values of capacitance, inductance and resistance which may be used for the components shown in circuit 200 of FIG. 5.

TABLE II

| | |
|---|---|
| RESISTORS | |
| FR2 | 0.4 ohm |
| R30 and R31 | 0.22 ohm |
| CAPACITORS | |
| C21–C24 | 165 microfarads |
| C25 | 10 microfarads |
| C26 | 30 microfarads |
| INDUCTORS | |
| L8 | 5 millihenries |

Figure 6:
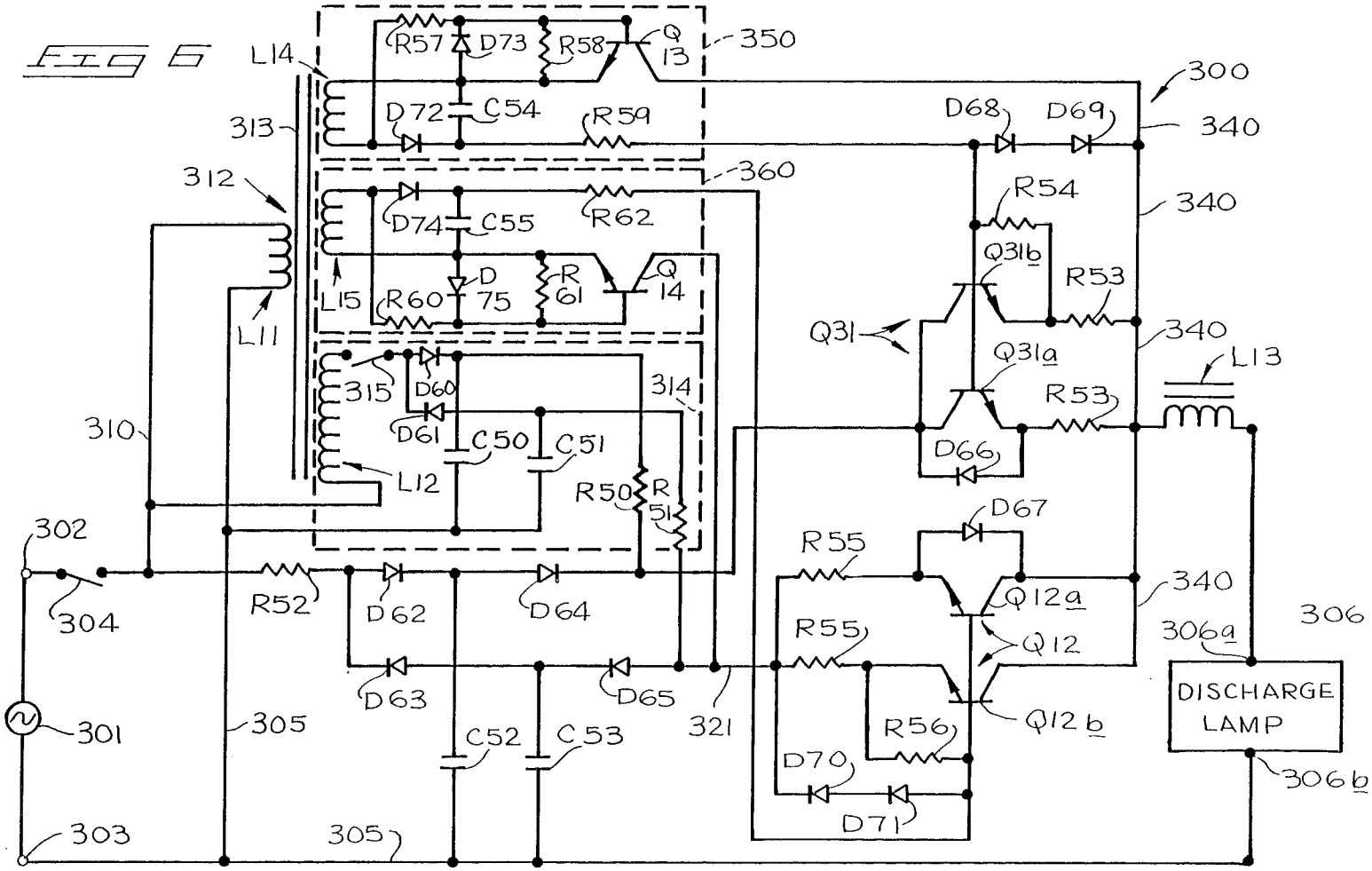
FIG. 6 is a schematic circuit diagram of an alternative ballast and starting circuit according to this invention.

FIG. 6 shows a further embodiment capacitive ballast circuit 300 according to this invention. Circuit 300 includes a source of alternating current 301 connected across terminals 302 and 303. A power on-off switch 304 can advantageously be provided to allow controlled supply of current to remaining portions of circuit 300. Circuit 300 is designed for use with a 120 volt rms single phase power supply with terminal 303 being common and terminal 302 experiencing the alternating voltage. Terminal 303 is connected to a conductor 305 which is connected to a number of components described below including one side **306*b* of an electrical discharge lamp 306. The opposite side 306*a* of lamp 306 is connected to remaining portions of circuit 300 which are used to startup and control current flow through lamp 306**.

The output side of switch 304 is connected to conductor 310 which and is connected to first sides of induction coils L11 and L12 which preferably form part of a transformer 312 having a core 313, or equivalents thereto. The second side of coil L11 is connected to common via conductor 305.

Coil L12 is part of a starting circuit 314. Coil L12 has a greater number of coils thereon than L11 to provide an increased voltage thereacross such as in the range of approximately ±500 volts peak, from the ±170 volts peak alternating current supplied by source 301. The second side of coil L12 is advantageously connected to a manual starting switch 315 which can be manually closed to provide increased starting voltage to both positive and negative sides of ballast circuit 300 as further explained below.

Switch 315 is connected to the anode of blocking diode D60 and to the cathode of blocking diode D61. The cathode of diode D60 is connected in parallel to a first side of a capacitor C50 and to a first side of resistor R50. The anode of diode D61 is connected in parallel to a first side of capacitor C51 and to a first side of resistor R51. The second side of resistor R50 is connected to conductor 320 and the second side of resistor R51 is connected to conductor 321. The second sides of capacitors C50 and C51 are connected to conductor 305.

Circuit 300 further includes a means for dividing incoming line current into positive and negative components corresponding to positive and negative currents flowing during positive and negative portions of the alternating current, respectively. Such means for dividing the alternating current includes blocking diodes D62 and D63. The anode of diode D62 and cathode of diode D63 are connected to conductor 310 through a surge resistor R52. The cathode of diode D62 is connected to a first side of positive capacitor C52. The second or opposite side of capacitor C52 is connected to common using conductor 305. Diode D62 allows positive current to flow therethrough to positively charge capacitor C52. The anode of diode D63 is connected to the first side of negative capacitor C53. The second or opposite side of capacitor C53 is connected to common using conductor 305. Diode D63 allows negative current to flow from conductor 510 therethrough to negatively charge capacitor C53.

The cathode of blocking diode D62 and the first side of capacitor C52 are connected to the anode of a further blocking diode D64. The cathode of diode D64 is connected to conductor 320. Diode D64 prevents flow of charge from starting capacitor C50 to positive capacitor C52.

The anode of blocking diode D63 and the first side of capacitor C53 are connected to the cathode of blocking diode D65. The anode of diode D65 is connected to conductor 321. Diode D65 prevents flow of charge from starting capacitor C51 to negative capacitor C53.

The output from the cathode of diode D64 is connected by conductor 320 to an appropriate positive switching device, such as switching transistors Q31 which are connected in parallel. Conductor 320 is connected to the collectors of transistors Q31. The emitters of switching transistors Q31 are connected to the first sides of parallel resistors R53. The opposite sides of resistors R53 are connected to conductor 340. A blocking diode D66 is connected in parallel across the collector and emitter of switching transistor Q31*a* with the cathode of diode D66 connected to the collector. A resistor R54 is connected in parallel between the bases of transistors Q31 and the emitter of transistor Q31*b*. Blocking diodes D68 and D69 are connected in series between the base of transistors Q31 and conductor 340 with the cathodes oriented toward conductor 340. The bases of positive switching transistors Q31 are connected in parallel to a positive switching control subcircuit 350, which will be described more fully below. The emitters of switching transistors Q31 are also connected to subcircuit 350 through resistors R53 and conductor 340.

The output from the anode of blocking diode D65 is connected by conductor 321 to an appropriate negative switching device, such as switching transistors Q12. Transistors Q12 are connected in parallel to conductor 321 via parallel resistors R55 connected to the emitters of transistors Q12. The collectors of transistors Q12 are connected to conductor 340. A blocking diode D67 is connected in parallel across the emitter and collector of switching transistor Q12*a* with the anode connected to the emitter and the cathode connected to the collector. A resistor R56 is connected between the emitter and base of transistor Q12*b*. Blocking diodes D70 and D71 are connected in series from the base of transistors Q12 to conductor 321 with the cathodes oriented toward conductor 321. The bases of switching transistors Q12 are connected to a negative switching control subcircuit 360 which will be described more fully below. The emitter of switching transistors Q12 are also connected to subcircuit 360 through resistors R55.

The current outputs from switching means Q31 and Q12 are conducted by conductor 340 through an inductive choke L13 to discharge lamp 306.

Switching control circuits 350 and 360 are conceptually and structurally similar. Each is designed to properly sense the phase of the incoming current supplied by source 301. During positive portions of the a-c current the positive switching control circuit 350 reverse biases positive switching means Q31 into a nonconductive mode. During negative portions of the incoming current circuit 350 forwardly biases switching means Q31 into a conductive mode. Negative switching control circuit 360 operates asynchronously to circuit 350 controlling negative switching means Q12 into a conductive mode during positive portions and into a nonconductive mode during negative portions. Having briefly outlined the overall function of control circuits 350 and 360, the structures thereof will now be described in detail.

Positive switching control circuit 350 includes an inductive coil L14 which can advantageously be on the secondary side of transformer core 313. Coil L14 develops appropriate control circuit potential and alternating current such as, for example, 6 volts and ½ amp, respectively. The first side of coil L14 is connected to the emitter of an appropriate switching device such as transistor Q13. The collector of transistor Q13 is connected to conductor 340. Transistor Q13 is the primary element in circuit 350 serving to switch coil L14 to positive switching transistors Q31 and provide a forward bias thereon during negative portions of the alternating current.

The second side of coil L14 is connected to the anode of blocking diode D72 and to a first end of resistor R57. The cathode of diode D72 is connected to one side of capacitor C54 and to resistor R59. Resistor R59 is also connected to the bases of positive switching transistors Q31, and to the anode of blocking diode D68. The cathode of diode D68 is connected to the anode of blocking diode D69. The cathode of diode D69 is connected to conductor 340.

Circuit 350 is further constructed by connecting the second end of resistor R57 to the cathode of blocking diode D73, the base of transistor Q13, and one end of resistor R58. The anode of diode D73 is connected to the emitter of transistor Q13 and to the opposite end of resistor R58. The second side of capacitor C54 is also connected to the emitter of transistor Q13.

Negative switching control circuit 360 includes an inductive coil L15 which is also advantageously on the secondary side of transformer core 313. Coil L15 develops potential and current similar to L14. The first side of coil L15 is connected to the anode of blocking diode D74 and the second side of coil L15 is connected to the emitter of transistor Q14. The collector of transistor Q14 is connected to the emitters of negative switching transistors Q12 via conductor 321 and resistors R55. The cathode of diode D74 is connected to a first side of capacitor C55 and to a first end of resistor R62. The opposite end of resistor R62 is connected to the bases of negative switching transistors Q12 and to the two series blocking diodes D70 and D71 oriented with the anodes toward resistor R62. The cathode of blocking diode D70 is connected to conductor 321. The second side of capacitor C55 is connected to the anode of blocking diode D75, the emitter of transistor A14, and the second side of coil L15. The cathode of diode D75 is connected to the base of control transistor Q14. The base of transistor Q14 is also connected to resistors R61 and R60. The opposite end of resister R61 is connected to the emitter of Q14 and the opposite end of resistor R60 is connected to the first side of coil L15.

Circuit 350 operates in the following manner. Coil L14 generates an appropriate alternating voltage thereacross in response to the induced magnetic flux in core 313. Transistor Q13 is reverse biased during positive portions of the line a-c in the following manner. During positive portions the first side of coil L14 (connected to the emitter of Q13) is positive relative to the second side of coil L14. The lower potential of the second side is connected through resistors R57 and diode D73 to the high side of coil L14. The base of transistor Q13 is at the potential established between resistor R57 and diode D73, which must be at a potential less than the emitter voltage because of the voltage drop across each. Transistor Q13 is thus biased into the nonconductive mode. Meanwhile diode D72 prevents current from flowing therethrough because of the relatively low potential at the anode thereof. The bias voltage of transistors Q31 is equalized by the connection thereacross by resistor R54, thus effectively zero biasing them into a nonconductive mode.

During negative portions of the line a-c the second side of coil L14 is relatively high compared to the first side of L14. This causes positive current to flow through resistors R57 and R58 to the low side of coil L14. The potential at the emitter of transistor Q13 is low because of the direct connection to the first side of 214. The base voltage is higher because of the connection between the base and the anode existing between resistors R57 and R58. Transistor Q13 is thus forwardly biased into a conductive mode. Current can accordingly flow from the high side of coil L14 through diode D72, resistor R59, diodes D68 and D69 and back through transistor Q13. This flow of current is smoothed by capacitor C54. The resulting potential at the bases of positive switching transistors Q31 is higher than at the emitters because of current flow through resistor R54, thus forwardly biasing transistors Q31 into a conductive mode.

Negative switching control circuit 360 operates substantially the same as circuit 350 except that the first side of coil L15 is connected to the blocking diode D74 and the second side of L15 to the emitter of transistor Q14. This is reverse of the arrangement in circuit 350 thereby causing negative switching control circuit 360 to forward bias switching transistors Q12 into a conductive mode during positive portions of the line a-c, and to zero bias transistors Q12 into a nonconductive mode during negative portions.

The operation of remaining portions of ballast and starting circuit 300 will now be considered in greater detail. During positive portions of line current switching transistors Q31 are biased into a nonconductive mode, and switching transistors Q12 are biased into a conductive mode as just described. During negative portions transistors Q31 are biased conductive and transistors Q12 are biased nonconductive. This asynchronous operation allows capacitor C52 to positively charge and capacitor C53 to discharge its negative charge through transistors Q12 during positive portions. Conversely during negative portions of line a-c capacitor C53 charges negatively and capacitor C52 discharges its positive charge through transistors Q31.

Positive capacitor C52 discharges during negative portions of line a-c during which terminal 303 is at a higher voltage than terminal 302. Nonetheless, positive charge exists on the first side of capacitor C52 because of blocking diode D62. Such is discharged through diode D64, switching transistors Q31, resistors R53, coil L13, discharge lamp 306 back to common terminal 303. Negative capacitor C53 discharges during positive portions during which terminal 302 is at a relatively higher voltage than common terminal 303. Nonetheless, the negative charge exists on the first side of capacitor C53 because of blocking diode D63. Such is discharged through diode D65, resistors R55, transistors Q12, coil L13, discharge lamp 306 back to common terminal 303.

Starting circuit 314 supplements the voltage supplied through transistors Q31 and Q12 to lamp 306. This is accomplished by charging capacitor C50 during positive portions to a relatively high starting voltage and then first discharging capacitor C50 through transistors Q31 during negative portions when transistors Q31 are in the conductive mode. Conversely, circuit 314 also supplements the negative charge and starting voltage by charging capacitor C51 during negative cycle portions to a relatively high starting voltage and then discharging capacitor C51 through transistors Q12 during positive portions when transistors Q12 are in a conductive mode. Starting circuit 314 is manually controlled by switch 315.

Table III presents preferred values of resistance, inductance and capacitance for resistors, inductors and capacitors useful in a preferred form of circuit 300.

TABLE III

| | |
|---|---|
| RESISTORS | |
| R50, R51 | 100 ohm |
| R52 | 0.5 ohm |
| R53, R55 | 0.15 ohm |
| R54, R56 | 100 ohm |
| R57, R60 | 47 ohm |
| R58, R61 | 22 kilohm |
| R59, R62 | 47 ohm |
| CAPACITORS | |
| C50, C51 | 10 microfarads |
| C52, C53 | 330 microfarads |
| C54, C55 | 1000 microfarads |
| INDUCTORS | |
| L13 | 5 millihenries |

Figure 7:
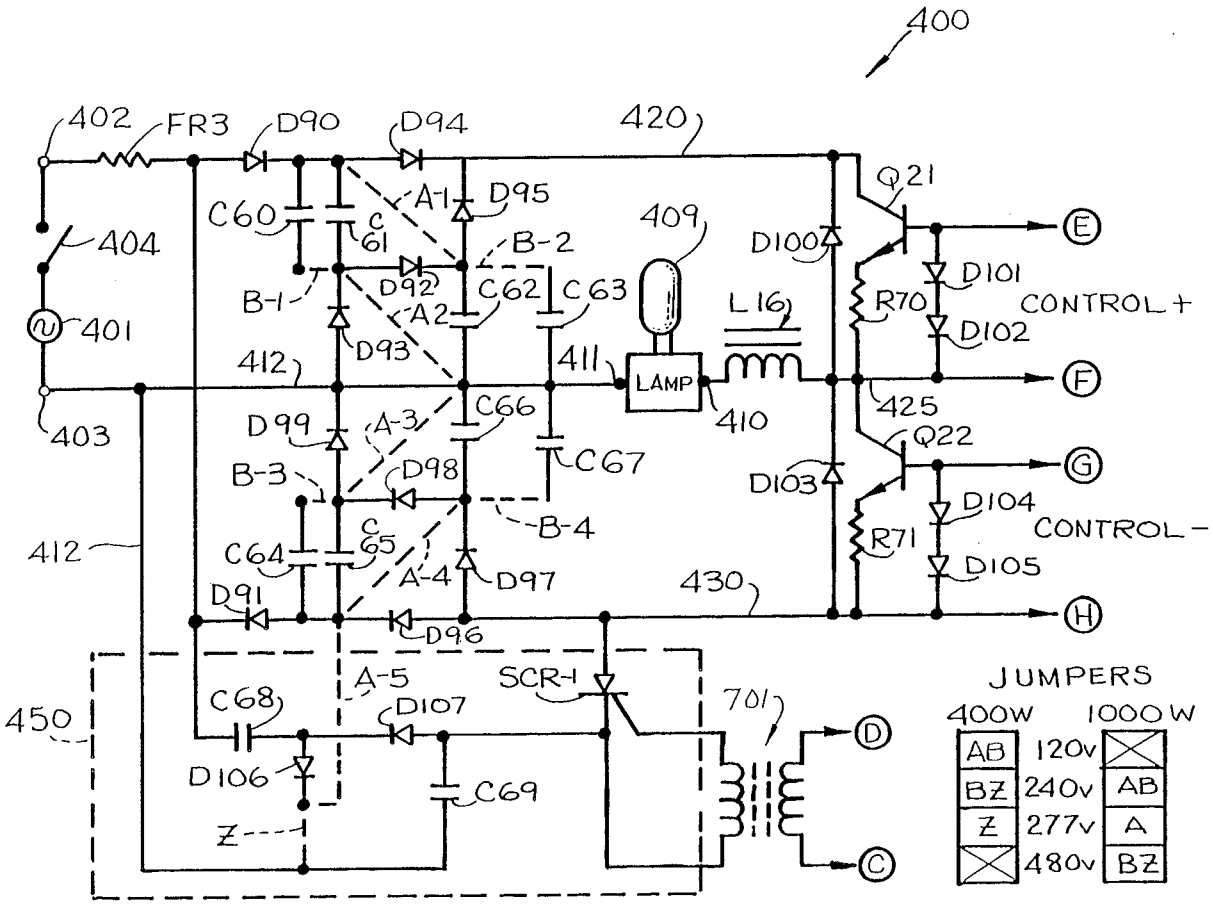
FIG. 7 is a schematic circuit diagram of a further embodiment of the invention.

A portion of a still further embodiment ballast and starting circuit 400 according to this invention is shown in FIG. 7. Current is supplied by current source 401 to terminals 402 and 403. On-off switch 404 is also advantageously provided to control current flow from source 401. Fusable surge resistor FR3 is connected at one end to terminal 402. The opposite end of surge resistor FR3 is connected to the anode of blocking diode D90 and to the cathode of blocking diode D91. Diodes D90 and D91 divide the alternating line current into positive and negative portions, respectively.

The cathode of diode D90 is connected to first sides of capacitors C60 and C61, and to the anode of blocking diode D94. The cathode of diode D90 is also connected by optional conductor A-1 to the cathode of blocking diode D92, to the anode of blocking diode D95, and to the first side of capacitor C62. Optional conductor or jumper A-1 and other jumpers are used as described below to convert circuit 400 for different voltages and wattages of metal halide discharge lamps 409. Optional conductors or jumpers labelled A, B, and Z will be hereinafter described for use with appropriate lamp types as also hereinafter described.

The second side of capacitor C61 is connected to the anode of blocking diode D92 and to the cathode of blocking diode D93. The second side of capacitor C60 is optionally connected by jumper B-1 to the second side of capacitor C61 when lamp 409 is of a type requiring B jumper connections. The second side of capacitor C61 is also optionally connected by jumper A-2 to the second side of capacitor C62 when lamp 409 is of a type requiring A jumpers. The second side of capacitor C62 and the anode of blocking diode D93 are both connected to conductor 412. A further capacitor C63 has a second side which is also connected to conductor 412. The first side of capacitor C63 is optionally connected by jumper B-2 to the first side of capacitor C62 and the anode of blocking diode D95. The cathodes of diodes D94 and D95 are both connected to conductor 420.

Capacitors C60–C63 serve to store positive charge passing through diode D90. Diodes D92–D95 route current for charging and discharging capacitors C60–C63, as will be more fully explained below in connection with operation of circuit 400. Conductor 420 conducts positive change from capacitors C60–C63 to an appropriate positive switching means such as positive switching transistor Q21.

The negative current flowing through diode D91 is supplied to an arrangement of blocking diodes D96–D99 and capacitors C64–C67, conceptually similar to the arrangement just described for the positive current output flowing from diode D90. The anode of diode D91 is connected to the first sides of capacitors C64 and C65, and to the cathode of blocking diode D96. The anode of diode D96 is connected to conductor 430. The second side of capacitor C65 is connected to the anode of blocking diode D99 and to the cathode of blocking diode D98. The second side of capacitor C64 is optionally connected by jumper B-3 to the second side of capacitor C65 to place it in parallel therewith when lamp 409 is of a type requiring B jumpers to be connected. The cathode of diode D99 is connected to conductor 412. The anode of diode D98 is connected to the cathode of diode D97 and to the first side of capacitor C66. The second side of capacitor C66 is connected to conductor 412. Capacitor C67 is connected with a second side to conductor 412. The anode of blocking diode D96 and the anode of diode D97 are connected to conductor 430.

Optional jumper A-3 is connected between the second side of capacitor C65 and conductor 412 when lamp 409 is of a type requiring A jumpers. Optional jumper A-4 is connected from the anode of diode D91 to the first side of capacitor C66 when lamp 409 requires A jumpers. Optional jumper B-3 is connected from the second side of capacitor C64 to the second side of capacitor C65 placing such capacitors in parallel when lamp 409 requires B jumpers to be connected. Optional jumper B-4 is connected between the first sides of capacitors C66 and C67 to place them in parallel also when B jumpers are required.

The assembly of capacitors C64–C67 and diodes D96–D99 allows negative current flowing through diode D91 to be stored in such capacitors, and be discharged therefrom through a negative switching means such as negative switching transistor Q22.

Positive switching transistor Q21 is connected in circuit 400 with its collector connected to conductor 420 and the emitter connected to a first end of resistor R70. The second end of resistor R70 is connected to conductor 425 which supplies current through induction coil or choke L16 to discharge lamp 409. The base of transistor Q21 is connected to the high or positive side of a positive switching control circuit such as 65 shown in FIG. 3 at conductor E. The positive switching control circuit 65 is also connected to conductor 425 by conductor F. The voltage differential developed by circuit 65 across E and F is used to appropriately bias transistor Q21 into a conductive mode during negative portions of incoming a-c, and into a nonconductive mode during positive portions of incoming a-c.

A blocking diode D100 is connected in parallel with switching transistor Q21 with the cathode connected to conductor 420 and the anode connected to conductor 425. Two blocking diodes in series D101 and D102 are connected between the base of Q21 and conductor F.

Negative switching transistor Q22 is connected in circuit 400 in a manner equivalent to that described in connection with positive switching transistor Q21 with modification for the negative instead of positive current being switched thereby. Negative current is supplied to the emitter of transistor Q22 from conductor 430 through resistor R71. The collector of transistor Q22 is connected to conductor 425 in order to supply current to lamp 409. The base of transistor Q22 is connected to a suitable negative switching control circuit such as at G of circuit 66 shown in FIG. 3. Negative switching control circuit 66 is also connected at H to conductor 430. The voltage across G and H provide an appropriate biasing voltage to place transistor Q22 into a conductive mode during positive portions of the a-c from source 401, and into a nonconductive mode during negative portions of a-c.

A blocking diode D103 is connected in parallel with switching transistor Q22 with anode to conductor 430 and cathode to conductor 425. Two blocking diodes 104 and 105 are connected in series with anodes to the base of Q22 and cathodes toward conductor 430.

Ballast and starting circuit 400 further includes a starting circuit 450 used to boost the voltage applied across the electrodes of lamp 409 during startup. Starting circuit 450 is connected to apply boosted voltage only to the negative side of circuit 400. Equivalent circuitry (not shown) can alternatively be provided to the positive side either with or without circuit 450.

Starting circuit 450 includes a silicon controlled rectifier SCR-1 connected with the anode thereof to conductor 430. The cathode of SCR-1 is connected to the anode of blocking diode D107, the first side of capacitor C69, and to terminal C of FIG. 4. The gate and cathode of SCR-1 is connected across one side of pulse transformer 701. The opposite side of pulse transformer 701 is connected across terminals C and D of FIG. 4. The second side of capacitor C69 is connected to conductor 412. The cathode of diode D107 is connected to the anode of blocking diode D106 and to the second side of capacitor C68. The first side of capacitor C68 is connected to the output side of surge resistor FR3. The cathode of diode D106 is optionally connected by either jumper Z or jumper A-5 to conductor 412 or the first side of capacitor C65, respectively.

Ballast and starting circuit 400 is designed for use with two different discharge lamp wattage models, 400 watts and 1000 watts. The 400 watt lamp can be operated by circuit 400 using alternating current sources having rms voltages of 120, 240 and 277 volts. The 1000 watt lamp can be operated by circuit 400 using alternating current sources having rms voltages of 240, 277 and 480 volts. In each case special or optional connections must be made to properly adapt circuit 400 for operation of the chosen lamp at the chosen voltage. FIG. 7 shows a chart indicating the type of jumpers which must be provided in order to adapt circuit 400 for the particular lamp and current source being used.

When a 400 watt lamp is used with 120 volt rms current then it is necessary to connect jumper types A and B. Type A jumpers include jumpers A-1 through A-5 which must all be connected in order to meet the type A jumper requirement. Type B jumpers include jumpers B-1 through B-4 which must all be connected in order to meet the B requirement. When a 400 watt lamp is used with a 240 volt rms current supply, it is necessary to connect type B jumpers and the single type Z jumper. Type A jumpers are not connected in such application. When the 400 watt lamp is used with a 277 volt rms current source then circuit 400 is adapted by only connecting the Z jumper.

Use of 1000 watt metal halide discharge lamps with circuit 400 requires a different selection of jumpers than when using the 400 watt lamp. The 1000 watt lamp and 240 volt rms current source requires connecting both jumpers types A and B. The 1000 watt lamp with a 277 volt rms current source requires using only the type A jumpers. The 1000 watt lamp with a 480 volt rms current source requires connection of both types B and Z jumpers only.

The operation of circuit 400 will now be explained. As with previously described embodiments of this invention, circuit 400 first divides the incoming alternating current from source 401 into a positive component and a negative component using blocking diodes D90 and D91, or some other suitable means for dividing the alternating current. The positive current supplied during positive portions of the alternating current passes through diode D90 and is charged in the appropriate capacitors C60–C63 depending upon the optional jumper connections required for the lamp and current source being employed. When jumpers type A are only being used, such as with a 1000 watt lamp at 277 volts rms, then positive current flow through diode D90 causes charging of capacitors C61 and C62 in parallel. Capacitors C61 and C62 also discharge in parallel. When jumper types A and B are both connected then capacitors C60–C63 all charge and discharge in parallel. When jumper types B and Z are both used then capacitors C60 and C61 charge as a parallel unit in series with capacitors C62–C63 as a parallel unit. Capacitors C60–C63 all discharge in parallel. When only type Z jumpers are used then only capacitors C61 and C62 are effectively charged in series, and discharged in parallel.

The charging and discharging of negative capacitors C64–C67 is equivalent to the charging and discharging just described for the various jumper combinations for positive capacitors C60–C63. In all cases capacitance is produced which is needed to effectively power the associated lamp and the operating potential is maintained at an appropriate level without applying unnecessarily high voltage across the lamp, thus optimizing the operating efficiency of the ballast circuit.

In any of the capacitance options indicated above, the positive capacitors charge positively during positive portions of the alternating current, and discharge during negative portions. Conversely, the negative capacitors charge negatively during negative portion of the a-c cycle, and discharge during positive portions. In order to accomplish this, it is necessary for the positive switching means Q21 to be zero biased into a nonconductive mode during positive portions and forwardly biased into a conductive mode during negative portions of the a-c cycle. Conversely, it is necessary for the negative switching means Q22 to be zero biased into a nonconductive mode during the negative portions and forwardly biased into a conductive mode during the positive portions. This is acomplished using switching control circuits such as 65 and 66 and applying the appropriately timed control voltages across terminals E, F, G and H, as explained above.

Proper asynchronous operation of positive and negative switching transistors Q21 and Q22 allows the positive and negative charge stored in positive capacitors C60–C63 and negative capacitors C64–C67, to be appropriately discharged through inductive choke L16 and lamp 409 back to current source 401.

The initiation of discharge lamp 409 requires a boosted startup voltage to be applied across the spaced electrodes of the lamp. Starting circuit 450 is used to provide a boosted negative voltage through switching transistor Q22 to lamp 409. Starting circuit 450 operates in the following manner. Switch 404 is closed upon startup and current begins to flow into the positive and negative capacitors in an alternate fashion during positive and negative portions of the a-c. During positive portions of current from source 401 terminal 402 is positive with respect to terminal 403 and the first side of capacitors C68 charges positively and the second side thereof charges negatively, thus establishing a potential thereacross. When the source 401 swings negative the potential across capacitor C68 is forced thereacross thus increasing the potential differential thereacross by the additional potential of the negative swing voltage. This increased negative voltage on the second side of capacitor C68 flows through diode D107 and further increases the negative charge on the first side of capacitor C69 with respect to ground. A gate pulse is applied via D to the gate of SCR-1 at or immediately after closing switch 404 thus closing SCR-1 for flow of negative current from capacitor C69 through SCR-1 during positive portions when the negative switching transistor Q22 is closed. The anode of SCR-1 is maintained positive relative to the cathode because of the boosted negative voltage produced by starting circuit 450. The high negative voltage stored on capacitor C69 allows intermittent delivery of a high voltage peak at the start of a positive portion of the alternating current which precedes discharge of capacitors C64–C67 because of the more negative potential existing on C69. This increased negative voltage allows arcing to occur across the electrodes of the discharge lamp 409, thus starting operation thereof.

Jumper A-5 is connected with some configurations, thus allowing small amounts of charge to be drawn from capacitors C65 and C64 (if connected) to the second side of C68. The use of jumper Z similarly allows negative charge to pass through diode D106 to the second side of C68 during positive portions of the alternating current.

Table IV presents preferred values of resistance, inductance, and capacitance for resistors, inductors, and capacitors useful in a preferred form of circuit 400.

TABLE IV

| | |
|---|---|
| RESISTORS | |
| FR3 | .1 ohm |
| R70 | .22 ohm |
| R71 | .22 ohm |
| CAPACITORS | |
| C60, C63, C64, C67 | 15 microfarads |
| C61, C62, C65, C66 | 150 microfarads |
| C68 | 30 microfarads |
| C69 | 10 microfarads |
| INDUCTORS | |
| L16 | 5 milihenries |

Figure 8:
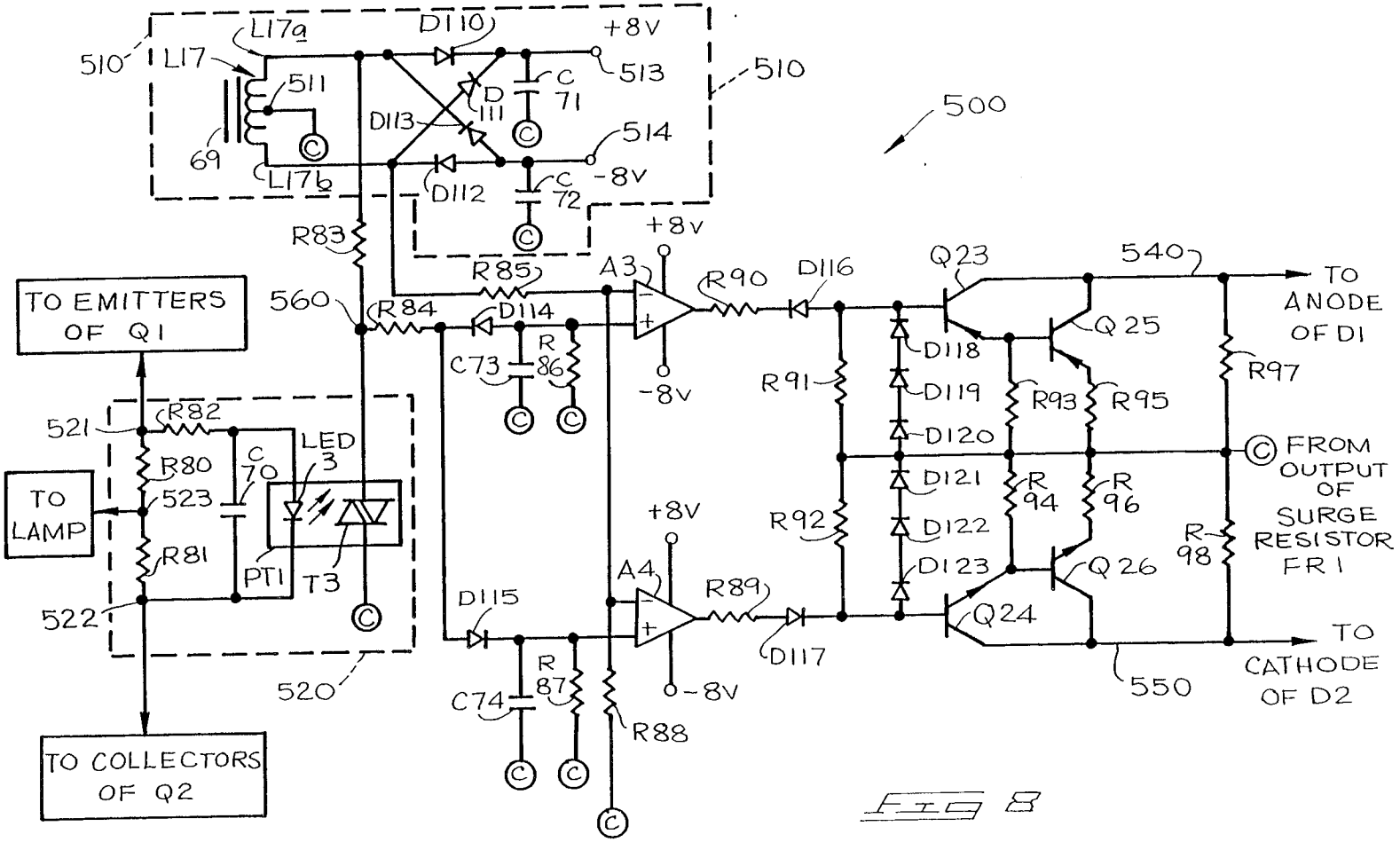
FIG. 8 is a schematic circuit diagram of a current regulating circuit useful with the embodiment shown in FIGS. 2, 3 and 4.

FIG. 8 shows a portion of a further preferred embodiment circuit 500 according to this invention. Circuit 500 is useful for controlling the amount of power supplied to the main positive and negative charge storage capacitors such as capacitors C1 and C2 of ballast and starting circuit 100 shown in FIGS. 2, 3 and 4. Circuit 500 regulates the power to such capacitors in order to prevent excessive current flow during startup to thereby preclude overheating of positive and negative switching means such as Q1 and Q2.

Switching regulator circuit 500 and equivalents thereof can be used in conjunction with a rnage of ballast circuits according to this invention. Circuit 500 is designed specifically to be used in conjunction with ballast circuits 100 and 200 described herein. The following description of circuit 500 will explain the application of circuit 500 with circuit 100. Similar application to ballast circuit 200 and other ballast circuits according to this invention will be readily apparent therefrom to one of ordinary skill in the art.

Regulator circuit 500 includes a power supply subcircuit 510 which is used to generate positive and negative direct current voltage supplies used by operational amplifiers such as A1 and A2 in circuit 100 of FIG. 4 and A3 and A4 of circuit 500. Power supply subcircuit 510 can be of a variety of constructions well known in the art of direct current power supplies.

A preferred form of circuit 510 advantageously employs a induction coil L17 which can advantageously be part of transformer 101 and share core 69. Alternatively induction coil L17 can be independent from other transformers used in the circuit. The primary side coil L5 of transformer 101 induces magnetic flux in core 69 which induces an alternating current in coil L17. A center tap 511 of coil L17 is preferably connected to the control ground or reference potential which is advantageously the same as the potential existing at the output of surge resistor FR1 of FIG. 2. Such control reference potential is indicated in the drawings by the letter C which is also similarly used in FIGS. 2–5.

One output from coil L17 is at terminal L17a which is connected to the anode of blocking diode D110 and to the cathode of blocking diode D113. The opposite terminal L17*b* is connected to the anode of blocking diode D111 and to the cathode of blocking diode D112. Diodes D110 and D111 allow positive current to flow therethrough from either side L17*a* or L17*b* of coil L17. Similarly, diodes D112 and D113 allow negative current to flow therethrough from either side of coil L17. Capacitors C71 and C72 smooth the resulting varying voltage passed through diodes D110–D113 to provide a suitably stable positive and negative direct current power supply at terminals 513 and 514, respectively.

Circuit 500 also includes a detection subcircuit 520 used to detect when current through switching transistors Q1 and Q2 exceeds a desirable level. Subcircuit 520 has a node 521 which is connected to the emitters of parallel positive switching transistors Q1. Connection of node 521 to the emitters of transistors Q2 obviates the need for using resistors R1 of FIG. 2, instead using resistor R80. Similarly, resistors R2 of FIG. 2 can be omitted from connection to the emitters of transistors Q2 because of resistance being provided by resistor R81. Resistors R80 and R81 provide a voltage differential between nodes 521, 522 and node 523 which is connected to lamp 32 either directly or preferably through choke L1.

Subcircuit 520 further includes resistor R82 which is connected at a first end thereof to node 521, and at a second end thereof to a first side of capacitor C70. The second side of capacitor C70 is connected to node 522. An optical isolator switching means such as photo-triac PT1 having a light emitting diode portion LED3 is connected in parallel with capacitor C70. Light emitting diode LED3 beams onto the photosensitive triac T3 causing it to close into a conductive mode when LED3 is provided with a sufficient minimum voltage thereacross to produce illumination.

Detection subcircuit 520 operates in the following manner. Current flows through switching transistors Q1 and Q2 as explained above with regard to ballast circuit 100. Positive current passing from the emitters of positive transistors Q1 is conducted through resistor R80 and to lamp 32. Similarly, negative current flows from the collectors of switching transistors Q2 through resistor R81 to lamp 32. With either positive or negative current flow there is a voltage drop across R80 or R81, respectively. The voltage drop across resistors R80 and R81 is directly proportional to the current flowing therethrough. During normal operation the current flowing through resistor R82 is not sufficient to create a voltage differential across capacitor C70 and LED3 which is sufficient to illuminate LED3. During periods of high current demand, such as at startup, then a sufficient voltage differential is developed across LED3 thereby causing it to illuminate and close triac T3 into a conductive mode. Triac T3, as part of phototriac PT1, controls the application of the voltage of node 560 to remaining portions of the circuit, which will now be described.

Circuit 500 further includes resistor R83 connected at a first end to the first side L17*a* of coil L17. The second end of resistor R83 is connected to the anode of photo-triac PT1. The cathode of photo-triac PT1 is connected to conductor C. A resistor R84 is also connected to the output of phototriac PT1 at one end. The other end of resistor R84 is connected to the cathode of blocking diode D114, and the anode of blocking diode D115. The cathode of blocking diode D114 is connected to the plus input of a comparative operational amplifier A3. The anode of diode D114 is also connected to the first side of capacitor C73 and the first side of resistor R86. The second sides of capacitor C73 and resistor R86 are connected to conductor C. The minus input of operational amplifier A3 is connected to a second end of resistor R85 and to a first end of resistor R88. The first end of resistor R85 is connected to the second side L17b of coil L17. The second end of resistor R88 is connected to conductor C.

The cathode of diode D115 is connected to the plus input of comparative operational amplifier A4. The cathode of diode D115 is further connected to the first side of capacitor C74 and resistor R87. The second sides of capacitor C74 and resistor R87 are connected to conductor C. The minus input of operational amplifier A4 is also connected to the second end of resistor R85 and the first end of resistor R88. Resistors R85 and R88 effectively divide the voltage between second side L17*b* and conductor C for use as a sinusoidal or other varying voltage against which the plus inputs of amplifiers A3 and A4 are compared.

The output from amplifier A3 is connected to one end of resistor R90. The opposite end of resistor R90 is connected to the cathode of blocking diode D116. The anode of blocking diode D116 is connected to the base of a PNP type control transistor Q23. The anode of blocking diode D116 is also connected to a first end of resistor R91 and the cathode of blocking diode D118. The second end of resistor R91 is connected to conductor C. The anode of diode D118 is connected in series with two other blocking diodes D119 and D120, with the anode of diode D120 being connected to conductor C.

The output of operational amplifier A4 is connected to an arrangement of components conceptually similar to that just described with respect to amplifier A3. The output of amplifier A4 is connected to one end of resistor R89. The other end of resistor R89 is connected to the anode of blocking diode D117. The cathode of diode D117 is connected to the base of NPN control transistor Q24. The cathode of diode D117 is also connected to one end of resistor R92 and to the anode of blocking diode D123. The opposite side of resistor R92 is connected to conductor C. The cathode of diode D123 is connected in series with two other blocking diodes D122 and D121, which are oriented with their anodes toward the base of transistor Q24. The cathode of diode D121 is connected to conductor C.

The emitters of control transistors Q23 and Q24 are connected to the bases of regulator transistors Q25 and Q26, respectively. Resistors R93 and R94 are connected between the emitters of transistors Q23 and Q24, respectively, and conductor C. The collector of transistor Q23 is connected to conductor 540 which is connected to the anode of diode D1 of FIG. 2. The collector of transistor Q25 is also connected to conductor 540. The collectors of transistors Q24 and Q26 are connected to the cathode of diode D2 via conductor 550. The emitters of transistors Q25 and Q26 are connected to conductor C via resistors R95 and R96, respectively. Resistors R97 and R98 are connected between conductor C and conductors 540 and 550, respectively.

The operation of circuit 500 will now be explained more fully. The functions of circuit 500 are primarily to detect when excessive current is being supplied to switching transistors Q1 and Q2 (FIG. 2) and then to control the percentage of time during which each of the positive and negative cycle portions are allowed to charge the main positive and negative capacitors C1 and C2. Transistors Q25 and Q26 are the switching elements which control the primary flow of current from conductor C therethrough, and supply the rectifying diodes D1 and D2. The percentage of time that current is supplied controls the resulting charge on capacitors C1 and C2 thus regulating the current discharged through main switching transistors Q1 and Q2. Regulation of the current flow through transistors Q1 and Q2 allows operation without excessive heat, thus extending the service life and reliability of the ballast circuits.

Detection of the current flow through transistors Q1 and Q2 is performed by detection subcircuit 520 as explained above. Detection circuit 520 not only detects excessive current but further provides a control signal during times of excess current which causes the control potential provided by first side L17*a* of coil 17 to be shunted to control ground, conductor C, through phototriac PT1. This shunting of control potential to the control ground or reference potential, controls the rectified voltage input to the plus terminals of amplifiers A3 and A4. The output from amplifiers A3 and A4 operates in the following manner.

During negative portions of alternating current the control coil L17 produces power which is passed through diode D114 to the plus or noninverting input of amplifier A3. Capacitor C73 smoothes the negative signal passing through diode D114 rendering it essentially direct current. Resistor R86 allows some current leakage to control ground (conductor C) so that increases and decreases in the potential at node 560 result in suitably quick response (1 second) by amplifier A3.

Amplifier A3 provides a negative output signal when the inverting input voltage exceeds the noninverting input voltage. During normal operation the inverting (−) input is less negative and thus exceeds the plus input to produce a −8 volt output to diode D116. This biases transistors Q23 and Q25 into a conductive mode allowing full power to reach the positive main capacitor C1.

If power is excessive then triac T3 is closed during a portion of the cycle and the potential at node 560 goes to control ground. The potential at the noninverting input thus increases becoming less negative and approaches control ground as capacitor C73 discharges through resistor R86. The potential on the inverting input of amplifier A3 varies positive and negative. When the alternating potential at the inverting input falls below the reduced negative potential of the noninverting input, then the output from amplifier A3 goes positive thus removing the biasing voltage to transistors Q23 and Q25 thereby placing them in a nonconductive mode. This terminates power to the main positive capacitor C1, thereby reducing the charge placed thereon and the power conducted through switching transistors Q1.

The operation of amplifier A4 and transistors Q24 and Q26 is essentially the same as the description just given with respect to amplifier A3 and transistors Q23 and Q25, except that the output from amplifier A4 is normally positive because the plus treminal is held at a higher positive voltage than the varying voltage at the minus terminal. This positive output biases transistors Q24 and Q26 closed providing full power to negative main capacitor C2. When phototriac PT1 closes it decreases so that the varying voltage at the minus input exceeds the voltage at the plus input during part of the negative cycle. This causes the output of A4 to go negative thereby removing the forward bias on transistors Q24 and Q26. The power supplied to negative main capacitor C2 and switching transistors Q2 is thus reduced. Transistor Q26 controls flow of negative current from conductor C to the cathode of rectifying diode D2.

Regulating circuit 500 thus controls current flow to both positive and negative main capacitors C1 and C2 in order to maintain a predetermined current flow through switching transistors Q1 and Q2.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. A ballast circuit for controlling electrical current flow through an electrical discharge lamp from an electricity source providing alternating electrical current having positive potential portions and negative potential portions, comprising:

positive electrical charge storage means connected to receive current from said electricity source during said positive potential portions;

negative electrical charge storage means connected to receive current from said electricity source during said negative potential portions;

at least one positive switching means connected between said positive electrical charge storage means and said lamp, and connected between said electricity source and said lamp;

at least one negative switching means connected between said negative electrical charge storage means and said lamp and connected between said electricity source and said lamp; and switching control means for controlling said positive switching means into a nonconductive mode during said positive potential portions and into a conductive mode during said negative potential portions, and for controlling said negative switching means into a nonconductive mode during said negative potential portions and into a conductive mode during said positive potential portions.

2. The ballast circuit of claim 1 wherein said switching control means comprises:

a positive switching control signal means for providing a positive switching control signal to said positive switching means; and a negative switching control signal means for providing a negative switching control signal to said negative switching means.

3. The ballast circuit of claim 1 further comprising current dividing means interconnected between said electricity source and said positive and negative electrical charge storage means.

4. The ballast circuit of claim 1 further comprising starting circuit means connected to the electricity source for providing a boosted starting voltage to at least one of said switching means.

5. The ballast circuit of claim 4 wherein the starting circuit is automatically controlled to operate during startup conditions and to discontinue operation after the discharge lamp has begun operation.

6. The ballast circuit of claim 4 wherein the starting circuit is manually switched into operation.

7. The ballast circuit of claim 1 wherein the positive and negative electrical charge storage means each comprise at least one capacitor.

8. The ballast circuit of claim 7 wherein there are at least two capacitors for each of said electrical charge storage means.

9. The ballast circuit of claim 7 wherein said positive and negative electrical charge storage means comprise at least two capacitors connected to charge in series and discharge in parallel.

10. The ballast circuit of claim 4 further comprising a starting control circuit for automatically activating the starting circuit upon supplying current to the ballast circuit, and for discontinuing operation of the starting circuit after operation of the discharge lamp has begun.

11. The ballast circuit of claim 10 wherein the starting control circuit further comprises startup indicator light means for indicating that the starting circuit means is operative and run indicator light means for indicating that the discharge lamp is drawing current.

12. The ballast of claim 4 wherein said starting circuit means includes:

startup signal generator means for creating a startup signal upon initiation of current from said electricity source to said ballast circuit;

voltage booster means for providing increased potential differential from current supplied by said electricity source; and bidirectional gated switch means connected to switch electrical current through said voltage booster means upon gating by said startup signal.

13. The ballast circuit of claim 1 further comprising a choke interconnected between the discharge lamp and said positive and negative switching means.

14. The ballast circuit of claim 1 wherein said positive and negative switching means are switching transistors.

15. The ballast circuit of claim 1 further comprising a switching regulator circuit means for controlling power through said positive and negative switching means.

16. A method for controlling current flow through an electrical discharge lamp from an electricity source providing alternating electrical current having positive potential portions and negative potential portions, comprising:

charging a positive charge storage means during said positive potential portions;

charging a negative charge storage means during said negative potential portions;

discharging said positive charge storage means through the discharge lamp during said negative potential portions; and discharging said negative charge storage means through the discharge lamp during said positive potential portions; and preventing direct flow of positive current from the electricity source through the discharge lamp during positive potential portions; and preventing direct flow of negative current from the electricity source through the discharge lamp during negative potential portions.

17. The method of claim 16 further comprising dividing electrical current from said electricity source into positive and negative currents for charging said positive and negative charge storage means, respectively.

18. The method of claim 16 wherein said discharging of said positive and negative charge storage means is accomplished by controllably connecting said charge storage means to the discharge lamp in an asynchronous manner.

19. The method of claim 18 further comprising the step of automatically providing boosted starting voltage to the discharge lamp during a startup period.

20. A ballast circuit for controlling electrical current flow through an electrical discharge lamp from an electricity source providing alternating electrical current having positive potential portions and negative potential portions, comprising:

positive electrical charge storage means connected to receive current from said electricity source during said positive potential portions;

negative electrical charge storage means connected to receive current from said electricity source during said negative potential portions;

at least one positive switching means connected between said positive electrical charge storage means and said lamp, and connected between said electricity source and said lamp; said positive switching means being connected to control the flow of substantially all positive current flow through the discharge lamp;

at least one negative switching means connected between said negative electrical charge storage means and said lamp and connected between said electricity source and said lamp; said negative switching means being connected to control the flow of substantially all negative current flow through the discharge lamp; and switching control means for controlling said positive switching means and said negative switching means in an alternating and asynchronous manner so that positive and negative currents are alternately conducted through the discharge lamp controlled by said positive and negative switching means.

21. The ballast circuit of claim 20 wherein said switching control means comprises:

a positive switching control signal means for providing a positive switching control signal to said positive switching means; and a negative switching control signal means for providing a negative switching control signal to said negative switching means.

22. The ballast circuit of claim 20 further comprising current dividing means interconnected between said electricity source and said positive and negative electrical charge storage means.

23. The ballast circuit of claim 20 further comprising starting circuit means connected to the electricity source for providing a boosted starting voltage to at least one of said positive or negative switching means.

24. The ballast circuit of claim 23 wherein the starting circuit means is automatically controlled to operate during startup conditions and to discontinue operation after the discharge lamp has begun operation.

25. The ballast circuit of claim 23 wherein the starting circuit means is manually switched into operation.

26. The ballast circuit of claim 20 wherein the positive and negative electrical charge storage means each comprise at least one capacitor.

27. The ballast circuit of claim 23 further comprising a starting control circuit for automatically activating the starting circuit upon supplying current to the ballast circuit, and for discontinuing operation of the starting circuit after operation of the discharge lamp has begun.

28. The ballast of claim 23 wherein said starting circuit means includes:

startup signal generator means for creating a startup signal upon initiation of current from said electricity source to said ballast circuit;

voltage booster means for providing increased potential differential from current supplied by said electricity source; and bidirectional gated switch means connected to switch electrical current through said voltage booster means upon gating by said startup signal.

29. The ballast circuit of claim 20 wherein said positive and negative switching means are switching transistors.

30. The ballast circuit of claim 20 further comprising a switching regulator circuit means for controlling power through said positive and negative switching means.

31. A ballast circuit for controlling and limiting electrical current flow through an electrical discharge lamp supplied from an electricity source providing alternating electrical current having positive potential portions and negative potential portions, comprising:

at least one positive charge storage means electrically connected to receive positive current from the electricity source and store sufficient positive charge to primarily power the discharge lamp during positive lamp discharge periods;

means for supplying electrical current during said positive potential portions to said positive charge storage means;

at least one negative charge storage means electrically connected to receive negative current from the electricity source and store sufficient negative charge to primarily power the discharge lamp during negative lamp discharge periods;

means for supplying electrical current during said negative potential portions to said negative charge storage means;

at least one positive switching means electrically connected to control positive current flow through the discharge lamp; said positive switching means being electrically connected to the positive charge storage means to controllably discharge positive charge from the positive charge storage means through the discharge lamp;

negative switching means electrically connected to control negative current flow through the discharge lamp; said negative switching means being electrically connected to the negative charge storage means to controllably discharge negative charge from the negative charge storage means through the discharge lamp;

means for controlling the positive and negative switching means so that only one of said positive or negative switching means is conductive at any time, and to alternately pass surges of positive and negative current which primarily power operation of the lamp in an alternating current mode of operation.

32. A ballast circuit according to claim 31 and further comprising at least one starting circuit means for providing a supplementary higher voltage during at least part of at least one of said surges of positive and negative current.

33. A ballast circuit according to claim 31 wherein said surges of positive and negative current operate at a lamp frequency corresponding with a line frequency at which said electricity source operates; and further comprising at least one starting circuit means for providing a supplementary higher voltage during at least part of at least one of said surges of positive or negative current.

34. A ballast circuit according to claim 31 wherein said surges of positive and negative current operate at a lamp frequency corresponding with a line frequency at which said electricity source operates.

35. A ballast circuit according to claim 31 wherein said surges of positive and negative current operate at a line frequency corresponding with the electricity source and wherein said surges of positive current are discharged through the discharge lamp during said negative potential portions, and said surges of negative current are discharged through the discharge lamp during said positive potential portions.

36. A ballast circuit according to claim 31 wherein said surges of positive current are discharged through the discharge lamp during said negative potential portions, and said surges of negative current are discharged through the discharge lamp during said positive potential portions.

37. A ballast circuit according to claim 36 and further comprising inductive choke means for regulating current flow through the discharge lamp.

38. A ballast circuit according to claim 31 and further comprising inductive choke means for regulating current flow through the discharge lamp.

39. A ballast circuit according to claim 31 further comprising at least one automatic starting circuit means for automatically providing a supplementary higher voltage during at least part of at least one of said surges of positive and negative current.

40. A ballast circuit according to claim 31 wherein there are a plurality of positive charge storage means and a plurality of negative charge storage means connected to charge in series and discharge in parallel.

41. A ballast circuit for controlling and limiting electrical current flow through an electrical discharge lamp supplied with electricity from an electricity source providing alternating electrical current having positive potential portions and negative potential portions, comprising:

at least one positive electrical energy storage means;

at least one negative electrical energy storage means;

means for supplying positive current from the electricity source to the positive electrical energy storage means for storage of positive electrical energy therein;

means for supplying negative current from the electricity source to the negative electrical energy storage means for storage of negative electrical energy therein;

at least one positive switching means electrically connected to control substantially all positive electrical current flow through the discharge lamp; said positive switching means also being electrically connected to receive and controllably conduct a positive current from said positive electrical energy storage means;

at least one negative switching means electrically connected to control substantially all negative electrical current flow through the discharge lamp; said negative switching means also being electrically connected to receive negative current from said negative electrical energy storage means;

means for controlling the positive and negative switching means to controllably conduct positive current from the positive electrical energy storage means through the discharge lamp during positive lamp discharge periods, and to controllably conduct negative current from the negative electrical energy storage means through the discharge lamp during negative lamp discharge periods, respectively; said positive and negative lamp discharge periods being asynchronous in time to prevent simultaneous discharge of positive and negative current.

42. A ballast circuit according to claim 41 and further comprising at least one inductive choke for regulating current flows through the discharge lamp.

43. A ballast circuit according to claim 42 and further comprising at least one starting circuit means for providing a supplementary higher voltage during at least part of at least one of said positive or negative lamp discharge periods.

44. A ballast circuit according to claim 43 wherein the starting circuit means is automatically controlled.

45. A ballast circuit according to claim 43 wherein the starting circuit means is manually controlled.

46. A ballast circuit according to claim 41 and further comprising at least one starting circuit means for providing a supplementary higher voltage during at least part of at least one of said positive or negative lamp discharge periods.

47. A ballast circuit according to claim 46 wherein the starting circuit means is automatically controlled.

48. A ballast circuit according to claim 47 wherein the starting circuit means is manually controlled.

49. A ballast circuit according to claim 41 wherein the positive and negative switching means are solid state switching devices.

50. A ballast circuit according to claim 49 wherein the positive and negative switching means are transistors.

51. A ballast circuit according to claim 41 wherein the positive and negative electrical energy storage means include capacitors.

52. A ballast circuit according to claim 41 wherein the positive and negative electrical energy storage means are capacitors.

53. A ballast circuit according to claim 41 wherein the positive and negative electrical energy storage means include capacitors, and further comprising at least one inductive choke means for regulating current flows through the discharge lamp.

54. A ballast circuit according to claim 53 wherein the positive and negative switching means are solid state switching devices.

55. A ballast circuit according to claim 54 wherein the positive and negative switching means are transistors.

56. A ballast circuit according to claim 54 and further comprising automatically controlled starting circuit means for providing a supplementary higher voltage during at least part of at least one of said positive or negative lamp discharge periods.

57. A ballast circuit according to claim 56 wherein at least one of said positive or negative electrical energy storage means includes at least two capacitors connected to charge in series and discharge in parallel.

58. A ballast circuit according to claim 54 wherein at least one of said positive or negative electrical energy storage means includes at least two capacitors connected to charge in series and discharge in parallel.

59. A ballast circuit according to claim 53 wherein at least one of said positive or negative electrical energy storage means includes at least two capacitors connected to charge in series and discharge in parallel.

60. A method for controlling and limiting current flow through an electrical discharge lamp powered by an electricity source providing alternating electrical current having positive potential portions and negative potential portions, comprising:

storing positive electrical energy conducted from said electricity source during said positive potential portions in at least one positive electrical energy storage means;

storing negative electrical energy conducted from said electricity source during said negative potential portions in at least one negative electrical energy storage means;

controlling conduction of positive current through the discharge lamp using at least one positive switching means which is controlled between a substantially nonconductive condition and a conductive condition; said positive switching means serving to control conduction of positive current through the discharge lamp to define positive lamp discharge periods;

controllably conducting positive electrical current from the positive electrical energy storage means through the positive switching means to power the lamp during the positive lamp discharge periods;

controlling conduction of negative current through the discharge lamp using at least one negative switching means which is controlled between a substantially nonconductive condition and a conductive condition; said negative switching means serving to control conduction of negative current through the discharge lamp to define negative lamp discharge periods;

controllably conducting negative electrical current from the negative electrical energy storage means through the negative switching means to power the lamp during the negative lamp discharge periods;

controlling the positive and negative switching means so that only one of said positive or negative switching means is conductive at any particular time to conduct positive and negative electrical currents through the discharge lamp in an alternating current mode of operation.

61. A method according to claim 60 further comprising dividing electrical current from the electricity source into positive and negative current portions which are conducted to the positive and negative electrical energy storage means, respectively.

62. A method according to claim 60 wherein the positive switching means is controlled to be conductive only during said negative potential portions of the aternating electrical current from the electricity source, and the negative switching means is controlled to be conductive only during said positive potential portions of the alternating electrical current from the electricity source.

63. A method according to claim 60 wherein the positive and negative switching means are operated in a consecutively alternating manner to define consecutively alternating positive and negative lamp discharge periods.

64. A method according to claim 60 wherein said storing positive electrical energy includes charging at least one positive electrical charge storage means, and said storing negative electrical energy includes charging at least one negative electrical charge storage means.

65. A method according to claim 60 wherein said storing positive electrical energy includes charging at least one positive capacitor, and said storing negative electrical energy includes charging at least one negative capacitor.

66. A method according to claim 62 wherein said storing positive electrical energy includes charging at least one positive electrical charge storage means, and said storing negative electrical energy includes charging at least one negative electrical charge storage means.

67. A method according to claim 62 wherein said storing positive electrical energy includes charging at least one positive capacitor, and said storing negative electrical energy includes charging at least one negative capacitor.

68. A method for controlling and limiting current flow through an electrical discharge lamp powered by an electricity source providing alternating electrical current having positive potential portions and negative potential portions, comprising:

charging at least one positive charge storage means with positive current conducted from the electricity source;

charging at least one negative charge storage means with negative current conducted from the electricity source;

controlling conduction of positive current through the discharge lamp using at least one positive switching means which is controlled between a substantially nonconductive condition and at least one conductive condition; said positive switching means serving to control conduction of positive current through the discharge lamp to define positive lamp discharge periods;

controllably conducting positive electrical current from the positive charge storage means through the positive switching means to power the lamp during the positive lamp discharge periods;

controlling conduction of negative current through the discharge lamp using at least one negative switching means which is controlled between a substantially nonconductive condition and at least one conductive condition; said negative switching means serving to control conduction of negative current through the discharge lamp to define negative lamp discharge periods;

controllably conducting negative electrical current from the negative charge storage means through the negative switching means to power the lamp during the negative lamp discharge periods;

controlling the positive and negative switching means so that only one of said positive or negative switching means is conductive at any particular time to conduct positive and negative electrical currents through the discharge lamp in an alternating current mode of operation.

69. A method according to claim 68 further comprising dividing electrical current from the electricity source into positive and negative current portions which are conducted to the positive and negative charge storage means, respectively.

70. A method according to claim 68 wherein the positive switching means is controlled to be conductive only during said negative potential portions of the alternating electrical current from the electricity source, and the negative switching means is controlled to be conductive only during said positive potential portions of the alternating electrical current from the electricity source.

71. A method according to claim 70 wherein said charging at least one positive charge storage means includes charging at least one positive capacitor, and said charging at least one negative charge storage means includes charging at least one negative capacitor.

72. A method according to claim 68 wherein the positive and negative switching means are operated in a consecutively alternating manner to define consecutively alternating positive and negative lamp discharge periods.

73. A method according to claim 68 wherein said charging at least one positive charge storage means includes charging at least one positive capacitor, and said charging at least one negative charge storage means includes charging at least one negative capacitor.

74. A method for controlling and limiting current flow through an electrical discharge lamp powered by an electricity source providing alternating electrical current having positive potential portions and negative potential portions, comprising:

charging at least one positive charge storage means during said positive potential portions with sufficient energy to power the discharge lamp during positive lamp discharge periods;

charging at least one negative charge storage means during said negative potential portions with sufficient energy to power the discharge lamp during negative lamp discharge periods;

controlling the discharge of electrical current through the discharge lamp using at least one positive switching means and at least one negative switching means; said positive switching means being elecrically connected to control discharge of positive operating current through the discharge lamp to define positive lamp discharge periods, and said negative switching means being electrically connected to control discharge of negative operating current through the discharge lamp to define negative lamp discharge periods;

controllably discharging positive charge stored by the positive charge storage means through the positive switching means and the discharge lamp;

controllably discharging negative charge stored by the negative charge storage means through the negative switching means and the discharge lamp;

controlling the discharge of electrical current through the discharge lamp so that only one of said positive switching means or negative switching means is conductive at any particular time;

controlling the discharge of electrical current through the discharge lamp so that current flow therethrough is alternating current.

75. The method of claim 74 further comprising dividing electrical current from said electricity source into positive and negative currents for charging said positive and negative charge storage means, respectively.

76. A method according to claim 74 further defined by said positive switching means being conductive during negative potential portions of the electricity source, and said negative switching means being conductive during positive potential portions of the electricity source.

77. A method according to claim 74 further defined by controlling the positive and negative switching means to consecutively alternate discharge of positive and negative currents through the discharge lamp in an alternating current mode of operation.

78. A method according to claim 77 further defined by said positive switching means being conductive only during negative potential portions of the electricity source, and said negative switching means being conductive only during positive potential portions of the electricity source.

79. A method according to claim 74 further defined by regulating current flow through the discharge lamp using an inductive choke means.

80. A method according to claim 75 further defined by regulating current flow through the discharge lamp using an inductive choke means.

81. A method according to claim 76 further defined by regulating current flow through the discharge lamp using an inductive choke means.

82. A method according to claim 77 further defined by regulating current flow through the discharge lamp using an inductive choke means.

83. A method according to claim 78 further defined by regulating current flow through the discharge lamp using an inductive choke means.

84. A method according to claim 74 and further comprising discharging a starting circuit through at least one of said positive or negative switching means to provide current at a greater voltage than provided from the positive or negative charge storage means for facilitating discharge of the lamp.

* * * * *